US007784554B2

(12) United States Patent
Grady et al.

(10) Patent No.: US 7,784,554 B2
(45) Date of Patent: Aug. 31, 2010

(54) FIREFIGHTING VEHICLE

(75) Inventors: Clarence Grady, Larsen, WI (US); Michael R. Moore, Larsen, WI (US); Chad Trinkner, Neenah, WI (US); Andrew R. Manser, Neenah, WI (US); John Schultz, Oshkosh, WI (US); John Randjelovic, Henderson, NV (US)

(73) Assignee: Pierce Manufacturing Company, Appleton, WI (US)

( * ) Notice: Subject to any disclaimer, the term of this patent is extended or adjusted under 35 U.S.C. 154(b) by 1049 days.

(21) Appl. No.: 11/439,509

(22) Filed: May 23, 2006

(65) Prior Publication Data

US 2007/0284156 A1 Dec. 13, 2007

(51) Int. Cl.
*A62C 27/00* (2006.01)

(52) U.S. Cl. ..... 169/24; 169/13; 169/62; 169/52

(58) Field of Classification Search ..... 169/13–15, 169/24, 62; 296/190.05; 280/6.15
See application file for complete search history.

(56) References Cited

U.S. PATENT DOCUMENTS

| | | | | |
|---|---|---|---|---|
| 1,376,467 | A | 5/1921 | Simmon | |
| 1,463,569 | A * | 7/1923 | Bathrick | 169/24 |
| 2,916,997 | A * | 12/1959 | Francois | 415/198.1 |
| 3,083,790 | A | 4/1963 | McAfee et al. | |
| 3,188,966 | A | 6/1965 | Tetlow | |
| 3,500,961 | A | 3/1970 | Eberhardt et al. | |
| 3,726,308 | A | 4/1973 | Eberhardt | |
| 4,059,170 | A * | 11/1977 | Young | 180/54.1 |
| 4,157,733 | A * | 6/1979 | Ewers et al. | 169/24 |
| 4,337,830 | A | 7/1982 | Eberhardt | |
| 4,563,124 | A | 1/1986 | Eskew | |
| 4,586,743 | A | 5/1986 | Edwards et al. | |
| 4,587,862 | A | 5/1986 | Hoffman | |
| 4,811,804 | A | 3/1989 | Ewers et al. | |

(Continued)

FOREIGN PATENT DOCUMENTS

WO WO 03049987 A3 * 6/2003

OTHER PUBLICATIONS

Graphic image of what is understood by Applicants to be a 1923 Seagrave from the City of Los Angeles Fire Department in which the driver of the vehicle, in a non-tilt open truck cab, sat in a seat positioned over a fire pump (1 photograph, one sheet).

(Continued)

*Primary Examiner*—Len Tran
*Assistant Examiner*—Jason J Boeckmann
(74) *Attorney, Agent, or Firm*—Foley & Lardner LLP

(57) ABSTRACT

An improved firefighting vehicle of a type supporting a pump system (e.g., a fire pump system) is provided. The firefighting vehicle generally includes a chassis and an operator cab. The operator cab is movable (e.g.; tiltable, etc.) relative to the chassis between a transit position and a service position. The firefighting vehicle also includes a fire pump system supported by the chassis at least partially under a rear portion of the operator cab. Positioning the fire pump system in such a location may advantageously allow for a vehicle with improved maneuverability or handling, reduced overall length, reduced overall height, additional capacity for storage, and/or with a fire pump system that is relatively convenient to service.

36 Claims, 17 Drawing Sheets

U.S. PATENT DOCUMENTS

| | | | | | |
|---|---|---|---|---|---|
| 4,945,780 | A | * | 8/1990 | Bosma | 74/337.5 |
| 5,826,663 | A | * | 10/1998 | Sundholm | 169/24 |
| RE36,196 | E | * | 4/1999 | Eberhardt | 169/14 |
| 6,009,953 | A | * | 1/2000 | Laskaris et al. | 169/13 |
| 7,213,872 | B2 | * | 5/2007 | Ronacher et al. | 296/190.05 |
| 2005/0099885 | A1 | | 5/2005 | Tamminga | |
| 2005/0196269 | A1 | | 9/2005 | Racer et al. | |

OTHER PUBLICATIONS

Graphic image of what is understood by Applicants to be a late 1930s American LaFrance from the City of Topeka Fire Department in which a fire pump is mounted in a cowl area of a non-tilt truck cab (1 photograph, one sheet).

Graphic image of what is understood by Applicants to be a 1938 American LaFrance Duplex from the City of Los Angeles Fire Department in which a first fire pump is mounted in a cowl area of a non-tilt truck cab, and is operated by the chassis engine, and a second fire pump is mounted behind the truck cab, and is operated by another engine mounted in the rear body (1 photograph, one sheet).

Graphic image of what is understood by Applicants to be a Kenworth chassis possibly built by one of Neep, Roney, Howard Cooper, Hiser Bodyworks and/or Western States between the 1950s and the 1980s in which a canopy extending from the rear of a non-tilt truck cab covers a fire pump (1 photograph, one sheet).

Graphic images of what is understood by Applicants to be 1969 Western States from the Cornelius and/or Forest Grove Fire Department in which a fire pump is mounted into the front end of a non-tilt truck cab and the chassis is powered by a mid-engine (3 photographs, one sheet).

Graphic images of what is understood by Applicants to be 1993 Western States from the Cornelius Fire Department in which a fire pump is mounted into the front end of a tilt truck cab that does not move when the cab tilts (2 photographs, one sheet).

Promotional materials for "CBP, AP, and PSD Series Rear Mount Fire Pumps"; Hale Products, Inc., Conshohocken, Pennsylvania; printed from website http://www.haleproducts.com; Rev. 2 dated 2002 (one sheet).

Promotional materials for "RM Series Rear Mount Fire Pumps"; Hale Products, Inc., Conshohocken, Pennsylvania; printed from website http://www.haleproducts.com; Rev. 2 dated 2002 (one sheet).

Promotional materials for "S100 Fire Pump"; Waterous Company, South St. Paul, Minnesota; printed from website http://www.waterousco.com; Rev. dated Dec. 17, 2004 (two sheets).

* cited by examiner

FIREFIGHTING VEHICLE

BACKGROUND

The present application relates generally to the field of firefighting vehicles which are configured to pump or otherwise deliver a firefighting agent or suppressant (e.g., water, foam, etc.) to an area of interest. More specifically, the present application relates to the positioning and/or configuration of a pump system (e.g., a fire pump system, etc.) within a firefighting vehicle.

Firefighting vehicles come in a variety of different forms. For example, certain firefighting vehicles, known as pumpers, are designed to deliver large amounts of firefighting agents, such as water, foam, or any other suitable fire suppressant to an area of interest. One or more of the firefighting agents may be retrieved from a tank carried by the firefighting vehicle and/or may be retrieved from a source external the firefighting vehicle (e.g., hydrant, pond, etc.). Other firefighting vehicles, known as tankers, are designed to hold and/or transport relatively large quantities of firefighting agents. Still other firefighting vehicles, known as aerials, are designed to additionally elevate ladders or booms. Further still, some firefighting vehicles, known as specialized firefighting vehicles, are designed for responding to unique firefighting circumstances and may be designed for delivering firefighting agents to difficult to reach locations (e.g., airport rescue, etc.).

Regardless of form, a number of firefighting vehicles include a pump system supported by the vehicle chassis for pressurizing the firefighting agent retrieved from a tank or an external source. Typically, pump systems are supported by the vehicle chassis at either a middle portion of the firefighting vehicle (i.e., a midship mounted pump), a rear portion of the firefighting vehicle (i.e., a rear mounted pump), or a front portion of the firefighting vehicle in front of the radiator (i.e., a front mounted pump). Midship and rear pumps systems are generally contained within a body of the vehicle (e.g., a portion of the vehicle rearward of the cab, etc.).

The designs of existing pump systems (which often include large pumphouses) occupy a significant amount of space along the vehicle chassis thereby taking away space along the chassis that could otherwise be used for supporting additional equipment, firefighting agents, firefighters, etc. While some firefighting vehicles utilizing a midship pump or a rear mounted pump have extended lengths and/or heights to allow for increased space to support, equipment, firefighting agents, firefighters, etc., such designs may make high speed maneuvering through traffic and narrow thoroughfares difficult.

Besides occupying a substantial amount of space along the vehicle chassis, the location of the pump systems within existing firefighting vehicles (often being supported substantially above the chassis) cause the such vehicles to have a higher center of gravity or increased heights. Again having a higher center of gravity may make high speed maneuvering through traffic and narrow thoroughfares difficult, while increased heights require higher hose storage areas (since hoses are often stored above a pumphouse and/or above a water tank).

Further still, the design of many existing pump systems does not allow for convenient maintenance of components of the pump system. For example, many existing pump systems require the pump control panel to be removed in order to service and/or replace an impeller shaft of the pump. Removing the pump control panel may take longer than the actually servicing the impeller shaft of the pump system.

SUMMARY

One embodiment of the present application relates to a firefighting vehicle comprising a chassis, an operator cab movable relative to the chassis between a transit position and a service position, and a fire pump supported by the chassis at least partially under a rear portion of the operator cab.

Another embodiment of the present application relates to a firefighting vehicle comprising a chassis and an engine supported by the chassis and having a first power output and a second power output. The first power output of the engine is coupled to a transmission. The firefighting vehicle further comprises a fire pump powered by the second power output. The fire pump comprises an impeller shaft, an impeller fixed to a first end of the impeller shaft, and a clutch fixed to a second end of the impeller shaft. The clutch allows the impeller shaft to be selectively disengaged from the second power output of the engine.

Another embodiment of the present application relates to a firefighting vehicle comprising a chassis, a drive system supported by the chassis, and a fire pump powered by the drive system. The fire pump comprises an enclosure including a fluid inlet and two fluid outlets, a shaft supported by the enclosure and having an axis of rotation, and an impeller supported by shaft and having a periphery, the fluid inlet configured to direct a fluid into the enclosure along a path generally parallel to the axis. The two fluid outlets are each defined by the enclosure at the periphery of the impeller and configured to direct the fluid from the enclosure along respective paths generally perpendicular to the axis.

Another embodiment of the present application relates to a fire pump. The fire pump comprises a shaft, an impeller supported by the shaft (the impeller having a periphery), and a pump housing which encloses the impeller and supports the shaft for rotation about an axis. The housing includes a fluid inlet configured to direct a fluid into the housing along a path generally parallel to the axis. The housing further includes two fluid outlets each at the periphery of the impeller and configured to direct the fluid from the housing along respective paths generally perpendicular to the axis. The shaft rotates the impeller in a pumping direction to move fluid from the fluid inlet to the fluid outlets.

Another embodiment of the present application relates to a radial-flow liquid pump assembly. The pump comprises an enclosure including an inlet and two outlets, a shaft supported by the enclosure to rotate about an axis, and an impeller fixed to the shaft, located within the enclosure, and having an eye at its center and vanes extending from the eye. The inlet is orientated to direct liquid along the axis into the eye of the impeller and the outlets are orientated at the periphery of the impeller to direct water away from the impeller in directions perpendicular to the axis. The pump further comprises a clutch fixed to the shaft and separated from the impeller by a wall of the enclosure.

Another embodiment of the present application relates to a fire pump system. The fire pump system comprises a first shaft having a first end configured to be coupled to a power source (the first shaft rotating whenever the power source is operating), a second shaft extending generally parallel to the first shaft (the second shaft receives rotational energy from the first shaft), a clutch fixed to a first end of the second shaft, an impeller fixed to a second end of the second shaft, and a pump housing which encloses the impeller, supports the second shaft, and separates the impeller from the clutch, the housing including at least one fluid inlet and at least one fluid outlet. The clutch allows the second shaft to be selectively disengaged from the rotational energy of the first shaft.

DETAILED DESCRIPTION

Figure 1:
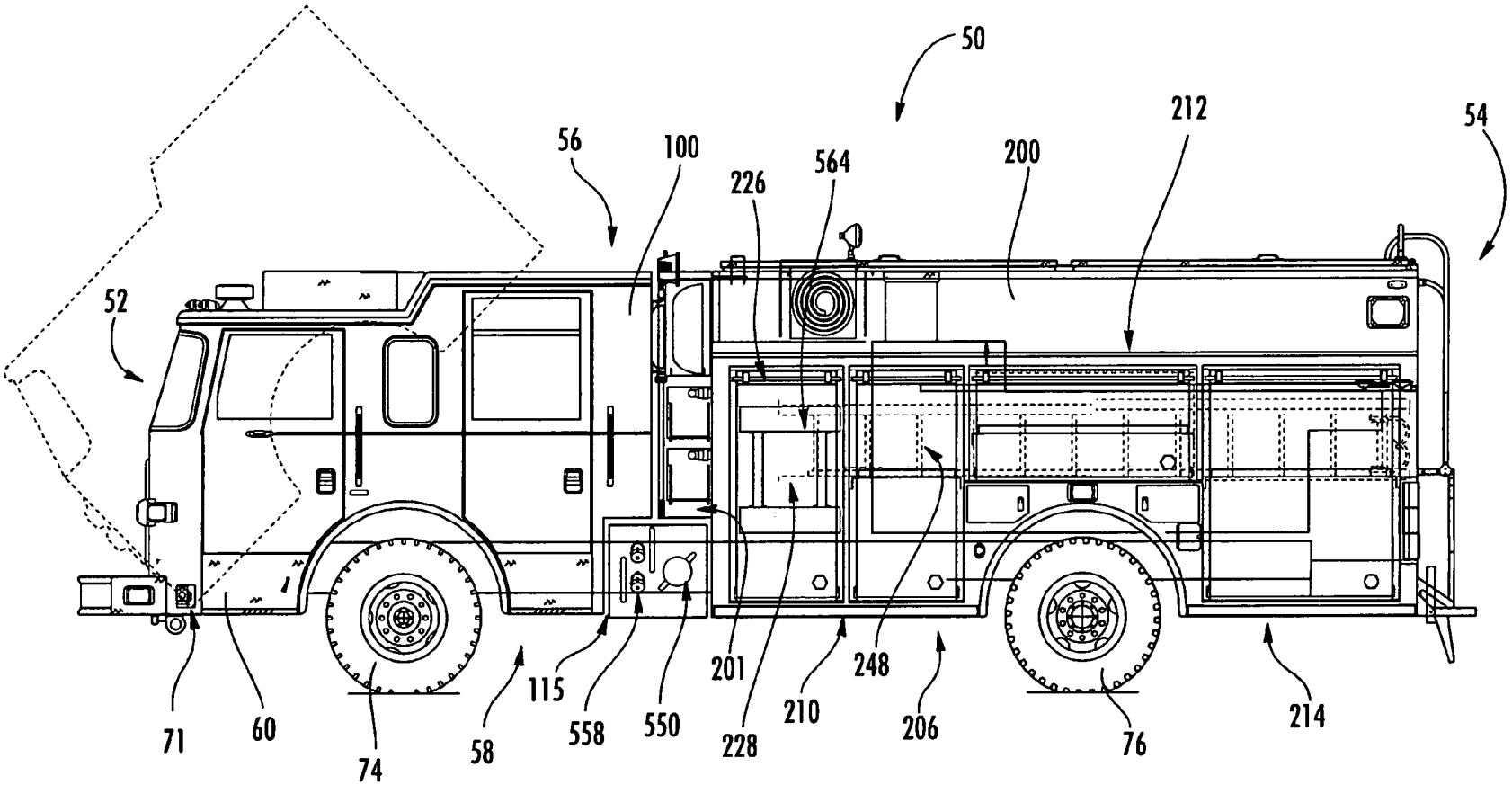
FIG. 1 is a driver side elevational view of a firefighting vehicle according to an exemplary embodiment.

Referring generally to the FIGURES, a vehicle and components thereof are shown according to exemplary embodiments. The vehicle is shown as a firefighting vehicle 50 which is configured to deliver a firefighting agent, such as water, foam and/or any other fire suppressant to an area of interest (e.g., building, environmental area, airplane, automobile, another firefighting vehicle, etc.). Vehicle 50 generally comprises a chassis, a cab supported at a front portion of the chassis, a body supported by the chassis rearward of the cab, a drive system for operating the vehicle and/or one or more systems thereof, and a pump system (hereinafter referred to as a "fire pump system") for pressurizing and/or displacing a firefighting agent.

According to one embodiment, the fire pump system is at least partially supported under a portion of the vehicle cab. Supporting the fire pump system at least partially under the cab may provide a variety of advantages. For example, supporting the fire pump system at least partially under the cab may allow vehicle 50 to be built with a shorter wheelbase (thereby improving maneuverability of the vehicle), may allow vehicle 50 to be have a shorter overall height (thereby providing lower access to hoses and/or storage compartments), may provide increased storage capacity along the chassis, and/or may provide improved accessibility to the fire pump system for maintenance and servicing (e.g., substantially unrestricted access to the fire pump system may be achieved from above the chassis, etc.).

The fire pump system may include a fire pump comprising a pump housing with a single fluid inlet and at least two fluid outlets. The two fluid outlets are configured to be substantially perpendicular to the fluid inlet and face opposites directions. This allows the fire pump to be supported on a vehicle such that the fluid inlet is parallel with a central axis of vehicle 50 while a fluid outlet outwardly faces each lateral side of the vehicle. Providing a pump housing with two outputs, rather than providing an external plumbing configuration which routes fluid from a single outlet on the pump housing to two or more fire hose connectors, advantageously allows for a more compact fire pump configuration (e.g., low profile, etc.). According to one embodiment, the two fluid outlets are provided in the portion of the pump housing that encloses an impeller of the fire pump (e.g., a volute, etc.).

The fire pump system is configured to be powered by a drive system of the vehicle. According to one embodiment, the drive system comprises an engine having a first power output configured to drive one or more wheels of the vehicle and a second power output configured to drive at least the fire pump system. The second power output of the engine rotates whenever the engine is operating. To selectively disengage (e.g., disconnect, declutch, etc.) the fire pump system from the second power output, a clutch assembly is fixed to an impeller shaft of the fire pump system. Fixing the clutch assembly to the impeller shaft, rather than operatively coupling the clutch between the second power output and a gear case, allows the impeller shaft to be selectively disengaged while the gear case continues to operate. A gear case that remains operating may be configured to receive an additional power take-off device (e.g., a standard power take-off device used with transmissions, etc.) used to operate one or more auxiliary systems (e.g., CAFS systems, generators, etc.)

Before discussing the details of firefighting vehicle 50, it should be noted at the outset that references to "front," "back," "rear," "upper," "lower," "right," and "left" in this description are merely used to identify the various elements as they are oriented in the FIGURES, with "front," "back," and "rear" being relative to the direction of travel of the vehicle. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring initially to FIGS. 1 through 5, vehicle 50 is illustrated according to one exemplary embodiment. Vehicle 50 is a self-propelled firefighting vehicle having a front 52, a rear 54, a top 56, a bottom 58 and a pair of opposite sides (a driver side or left side 60 and a passenger side or right side 62). Vehicle 50 is further shown as including a chassis 70, a cab 100, a body 200, a drive system 300, and a fire pump system 400.

Chassis 70, shown in the form of a frame 72, supports functional components of vehicle 50 including, but not limited to, front and rear motive members 74, 76. Front and rear motive members 74, 76 generally comprise ground motive members configured to propel or move vehicle 50. According to the embodiment illustrated, motive members 74, 76 comprise wheels coupled to axles (not shown). According to various alternative embodiments, motive members 74, 76 may comprise any other suitable for engaging a ground, track or other surface so as to propel or suspend vehicle 50. For example, motive members 74, 76 may comprise movable tracks such as commonly employed on tanks and some tractors. Although motive members 74, 76 are illustrated as being similar to one another, one set of motive members may alternatively be differently configured than motive members. For example, front motive members 74 may comprise wheels while rear motive members 76 comprise tracks.

Frame 72 generally comprises one or more structures configured to serve as the base or foundation (i.e., support structure) for the remaining components of vehicle 50. Frame 72 extends in a fore and aft direction an entire length of vehicle 50 along a longitudinal center line of vehicle 50. According to the embodiment illustrated, frame 72 generally includes a pair of parallel longitudinally extending frame members or frame rails 78 which are joined by one or more transversally extending cross members 80. Frame rails 78 are configured as elongated structural or supportive members (e.g., beams, channels, tubing, etc.). For example, according to an exemplary embodiment, frame rails 78 are elongated "C-channel" members with the open portion of the "C" facing the opposing frame member. Frame rails 78 are spaced apart in a lateral direction to define a void or cavity 82. As detailed below, cavity 82 provides a space for effectively mounting or otherwise supporting certain components of vehicle 50. According to various alternative embodiments, frame 72 may have any of a variety of suitable configurations.

Cab 100 is supported by chassis 70 and functions as an operator and/or occupant compartment for vehicle 50 by providing an enclosure or area suitable to receive an operator and/or occupant of the vehicle. Cab 100 includes a front 102, a rear 104, a top 106, a bottom 108 and a pair of opposite sides (a driver side or left side 110 and a passenger side or right side 112). One or more access openings can be provided in either, or both, of left side 110 or right side 112 to provide a means for ingress and egress. Although not shown, cab 100 includes controls associated with the manipulation of vehicle 50 (e.g., steering controls, throttle controls, etc.) and may optionally include controls associated with one or more auxiliary components of the vehicle 50 (e.g., foaming systems, fire pumps, aerial ladders, turrets, etc.).

Cab 100 is carried or otherwise supported at front 52 of frame 72 with at least a portion of cab 100 extending beyond a forward-most front motive member 74. Positioning cab 100 at front 52 increases the amount of space available along chassis 70 for such things as compartmental storage of equipment, firefighting agent storage tanks, hose beds, etc. Although cab 100 is illustrated as having a substantially flat front, according to various exemplary embodiments, cab 100 may have any of a variety of other suitable configurations other than the one example shown.

According to an exemplary embodiment, cab 100 is configured to be supported above or otherwise disposed over at least a portion of drive system 300 and fire pump system 400. As detailed below, drive system 300 and fire pump system 400 may be at least partially supported within cavity 82 (e.g., the centerline of vehicle 50, etc.) defined by rails 78. In an effort to increase clearance between the bottom of vehicle 50 and the ground for such an embodiment, drive system 300 and fire pump system 400 at least partially extend above frame rails 78. Cab 100 is configured to accommodate the positioning of drive system 300 and fire pump system 400 at least partially above frame rails 78. For example, bottom 108 of cab 100 includes a portion or raised floor that protrudes into the occupant compartment and defines an area (e.g., cavity, chamber, tunnel, etc.) configured to receive at least a portion of drive system 300 and fire pump system 400. This may include a portion extending in a fore and aft direction along a centerline of cab 100 (e.g., a tunnel, shroud, doghouse, etc.) and/or a portion or raised floor extending in a lateral direction along a rear portion of the cab 100 (e.g., a rear seat box, EMS compartment, storage receptacle, etc.).

According to the embodiment illustrated, fire pump system 400 is positioned such that a main portion of the fire pump system (e.g., a fire pump 410 and a gear case 450, etc.) is positioned under the rear portion of cab 100. To facilitate the positioning of fire pump system 400 under cab 100, the rear wall of cab 100 includes a central cutout portion that extends upward from a bottom edge and is sized to conform to or otherwise receive a portion of fire pump system 400 (e.g., a pump housing 414, etc.). To further accommodate the positioning of fire pump system 400, sides 110 and 112 of cab 100 are each shown as including a cutout portion 115 at their respective bottom rear corners. Cutout portion 115 is provided to allow a portion of a fluid routing system of fire pump system 400 to be supported under cab 100. For example, as detailed below, outlet hose connectors 558, 560 are supported under a rear portion of cab 100.

According to an exemplary embodiment, the entire cab 100 is movably (e.g., tiltably, slidably, removably, etc.) supported relative to frame 72. Cab 100 is configured to be selectively moved between a first or transit position (shown in FIG. 1) and a second or service position (shown in FIG. 7). In the service position, systems supported by the chassis beneath cab 100 (e.g., drive system 300, fire pump system 400, etc.) are more accessible from above chassis 70 than would otherwise be if cab 100 was in the transit position. Movably supporting cab 100 relative to frame 72 allows for relatively unrestricted or otherwise convenient access to systems (e.g., drive system 300, fire pump system 400, etc.) that may be supported at least partially under cab 100.

According to the embodiment illustrated, cab 100 is a tilt cab that is pivotally coupled to front 52 of chassis 70 about a pivot rod or shaft 71 located in front of the forward-most motive member 74. Pivot shaft 71 has an axis of rotation extending substantially perpendicular to rails 78 of the frame 72. Cab 100 is configured to be selectively tilted forward or rotated about pivot shaft 71 between the transit position and the service position. According to an exemplary embodiment, cab 100 is configured to be tilted forward using one or more powered actuators (e.g., electrical, hydraulic, etc.) up to approximately 45 degrees. A hoist or other suitable lifting means may be used to tilt cab 100 an angular distance greater than 45 degrees. According to various alternatives, any of a number of techniques may be used to tilt cab 100. A locking or latching device (not shown) may be provided to secure cab 100 in the transit position. Such a latching device may be used to couple cab 100 to a cross rail 80 extending between rails 78. For example, the latching device may couple cab 100 to the same cross rail 80 used to support a portion of fire pump system 400.

Vehicle 50 is further shown as including a body 200. Body 200 generally comprises the portion of vehicle 50 which forms an exterior of vehicle 50 rearward of cab 100 and which is configured for storing or otherwise supporting various components of vehicle 50, such as compressed air foam systems ("CAFS"), storage tanks, firefighting equipment (e.g., warning lights, hoses, nozzles, ladders, tools, etc.), and/or for providing an area for supporting one or more emergency response personnel (e.g., firefighters, etc.). Preferably, body 200 is formed of one or more compartmentalized sections. According to various alternative embodiments, body 200 may be provided as any of a number of structures depending on the particular application (e.g., water tank, flat bed, etc.).

A gap or space 201 may be provided between cab 100 and body 200. Space 201 may be provided above one or more fire hose connectors (e.g., inlet and/or outlet fire hose connectors, etc.) of fire pump system 400. According to the embodiment illustrated, space 201 is provided above an inlet fire hose connector, particularly inlet hose connectors 548, 550, in fluid communication with an inlet of fire pump system 400. Provided within space 201 is a support structure for holding one or more fire hoses (not shown). The support structure is shown as comprising one or more shelves 202 with openings at each lateral side of vehicle 50 to allow hoses supported thereon to be efficiently removed from either side of the vehicle when needed. Being able to support hoses directly above or otherwise near fire hose connectors in fluid communication with fire pump system 400 reduces the distance a firefighter must move the hose before connecting it to fire pump system 400 and thus may advantageously reduce the time it takes to connect a fire hose to a hose connector of fire pump system 400. Shelves 202 can also advantageously be provided relatively low to the ground thereby reducing firefighter strain (e.g., back strain, etc.) caused from loading and/or unloading the hoses. Space 201 may also include a platform 204 configured to support a firefighter trying to access shelves 202 or another portion of vehicle 50.

It should be noted that while vehicle 50 is shown as having a side mount pump control configuration (meaning that the controls associated with the operation fire pump system 400 are accessible to an operator from either left side 60 and/or right side 62), vehicle 50 may alternatively have a top mount pump control configuration (meaning that the pump controls are accessible to an operator at an elevated position). To accommodate one embodiment of a top mount pump control configuration (wherein the controls are accessible at a substantially central position), an elevated catwalk or platform (extending laterally relative to the chassis) upon which a firefighter could stand to operate fire pump system 400 may be provided in space 201. To accommodate a second embodiment of a top mount pump control configuration (wherein the controls are accessible at a side position), an elevated platform (extending longitudinally relative to the chassis) may be provided. According to still further alternative embodiments, body 200 may be substantially adjacent to cab 100 thereby eliminating or significantly reducing the size of any spacing between body 200 and cab 100.

Figure 2:
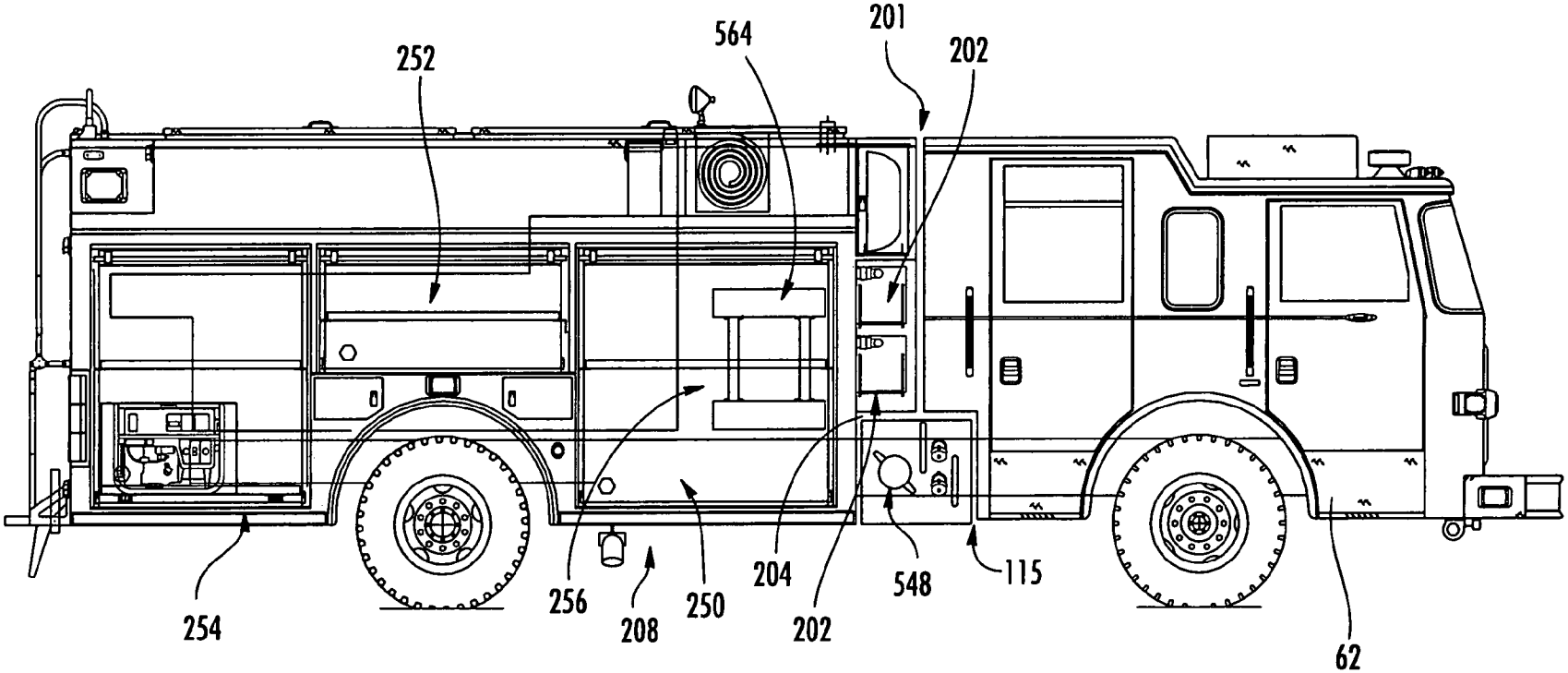
FIG. 2 is a passenger side elevational view of the firefighting vehicle of FIG. 1.
Figure 3:
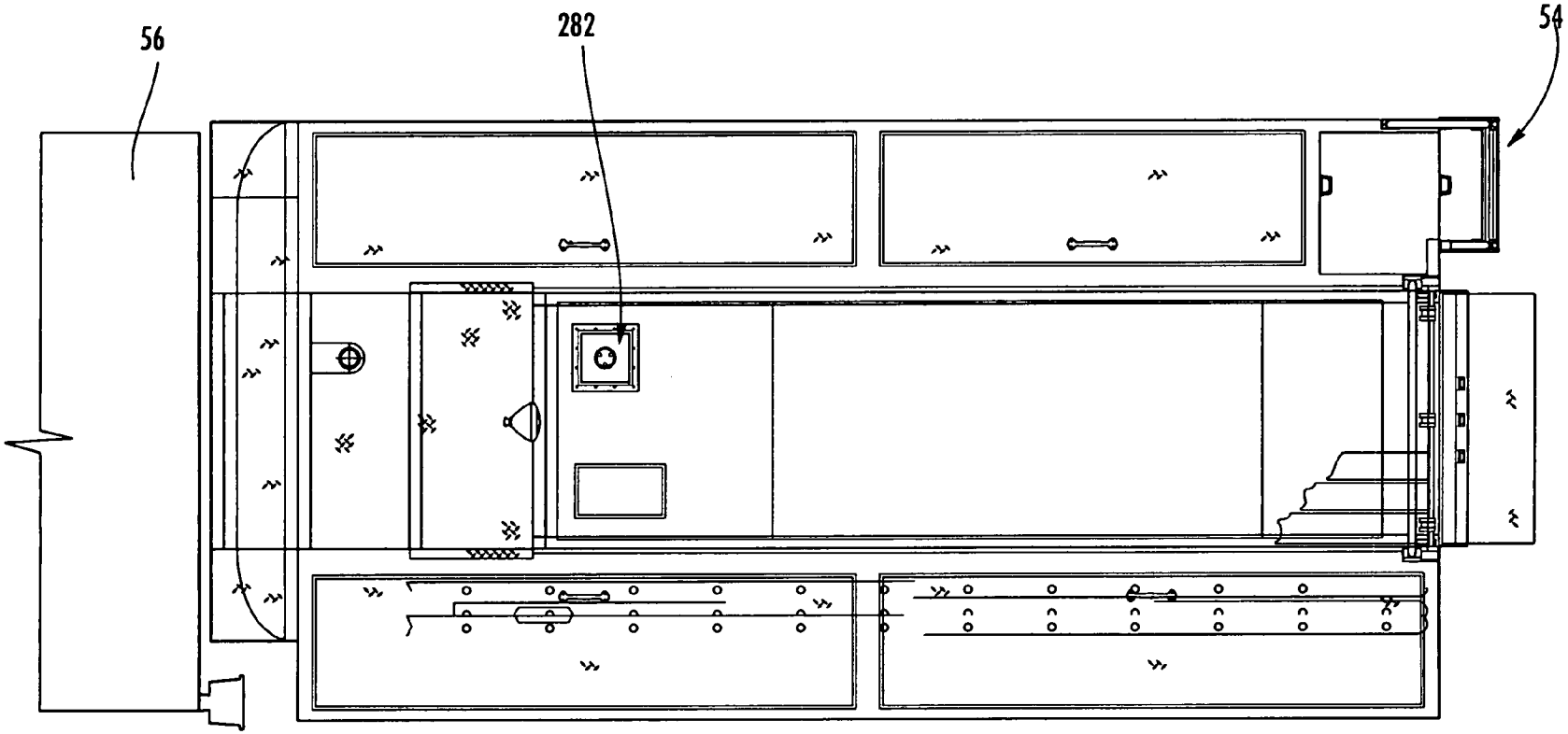
FIG. 3 is a top plan view of the firefighting vehicle of FIG. 1.
Figure 4:
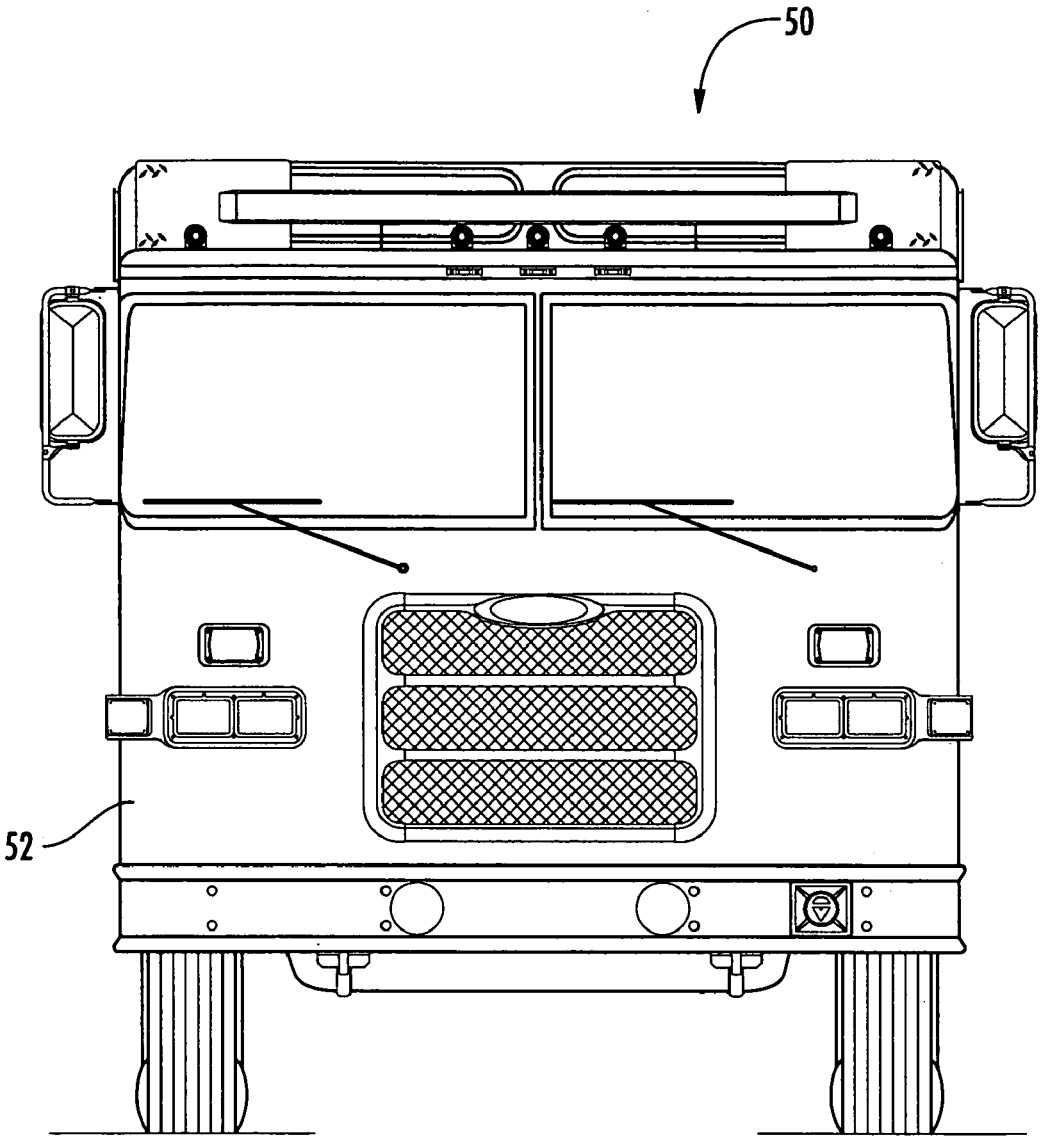
FIG. 4 is a front elevational view of the firefighting vehicle of FIG. 1.

Referring further to FIGS. 1 and 2, body 200 is formed of multiple sections (e.g., units, modules, etc.) which together define the rear portion of vehicle 50. According to the embodiment illustrated, body 200 includes a first or left side body section 206 (shown in FIG. 1) and a second or right side body section 208 (shown in FIG. 2). Each side body section 206 and 208 is shown as including at least one compartment allowing for the compartmentalized organization and/or storage of various firefighting tools, supplies, hoses, ladders, etc.

Side body sections 206, 208 are mounted on chassis 70 rearward of cab 100 from opposite lateral sides of vehicle 50. Side body sections 206, 208 are shown as wrapping about an upper side of motive member 76. Each side body section 206 and 208 is shown as having a first volume forward of motive member 76, a second volume above motive member 76, and a third volume rearward of motive member 76. The first, second, and third volumes may be integral with one or more of the other volumes to form a unitary one-piece body section, or alternatively, may be provided by separate compartments or sections. Side body sections 206, 208 may be substantially identical to each other, or alternatively, may have different configurations (e.g., a different number of compartments, compartments of differing in size, compartments for different purposes, etc.).

FIG. 1 shows side body section 206 according to one exemplary embodiment. The first, second, and third volumes of body section 206 are defined by individual sections shown as a forward compartment 210, a middle compartment 212, and a rearward compartment 214 respectively. Compartments 210, 212 and 214 generally comprise a floor 216, side panels 218, 220, a top panel 222 and a rear or back panel 224. Floor 216 provides a floor surface for the respective compartment. Side panels 218, 220 are substantially identical to one another and face one another. Compartments 210, 212 and 214 further include one or more covers (e.g., panels, shield, partitions, tarps, etc.), such as doors 226 (shown in a retracted position), that conceal and protect the contents of the respective compartment. Doors 226 may have of a number of suitable configurations (side hinged doors, top hinged door, sliding doors, roll-up doors, etc.). According to various alternative embodiments, one or more of doors 226 may be replaced with reciprocating drawers or trays having drawer fronts which conceal and protect the contents when closed.

Forward compartment 210 of body section 206 is configured to house or otherwise support a fire pump control panel 570 (shown in FIG. 19) operatively coupled to fire pump system 400. To accommodate fire pump control panel 570, an aperture or opening 228 is formed along back panel 224 of compartment 210. Opening 228 enables the linkage (e.g., mechanical and/or electrical, etc.) of fire pump control panel 570 to pass therethrough into the interior of body 200 between body sections 206, 208. For example, opening 228 may allow fire pump control panel 570 to be operatively coupled to a manifold 564.

As detailed below, fluid inlets and/or fluid outlets of fire pump system 400 (e.g., inlet hose connectors 548, 550, outlet hose connectors 558, 560, etc.) have been removed from fire pump control panel 570 and have been positioned forward of body 200. This has been done to help protect a pump operator positioned at fire pump control panel 570 from injury in the event that one or more hoses connected to the fluid inlets and/or fluid outlets would inadvertently become disconnected while under pressure (e.g., a pump operator does not have to stand over or adjacent to a pressurized fire hose while operating fire pump control panel 570, etc.). To further shield a pump operator from the pressurized fire hoses connected to respective fluid inlets and/or fluid outlets of fire pump system 400, a movable panel (not shown) such as a side-hinged door of compartment 210 may be selectively positioned between the pump operator and any fluid inlets and/or fluid outlets of fire pump system 400. According to various alternative embodiments, this panel may be any movable panel configured to be positioned between a pump operator and any fluid inlets and/or fluid outlets of fire pump system 400 (e.g., a slidable panel configured to retract into the space provided between cab 100 and body 200, etc.).

Figure 5:
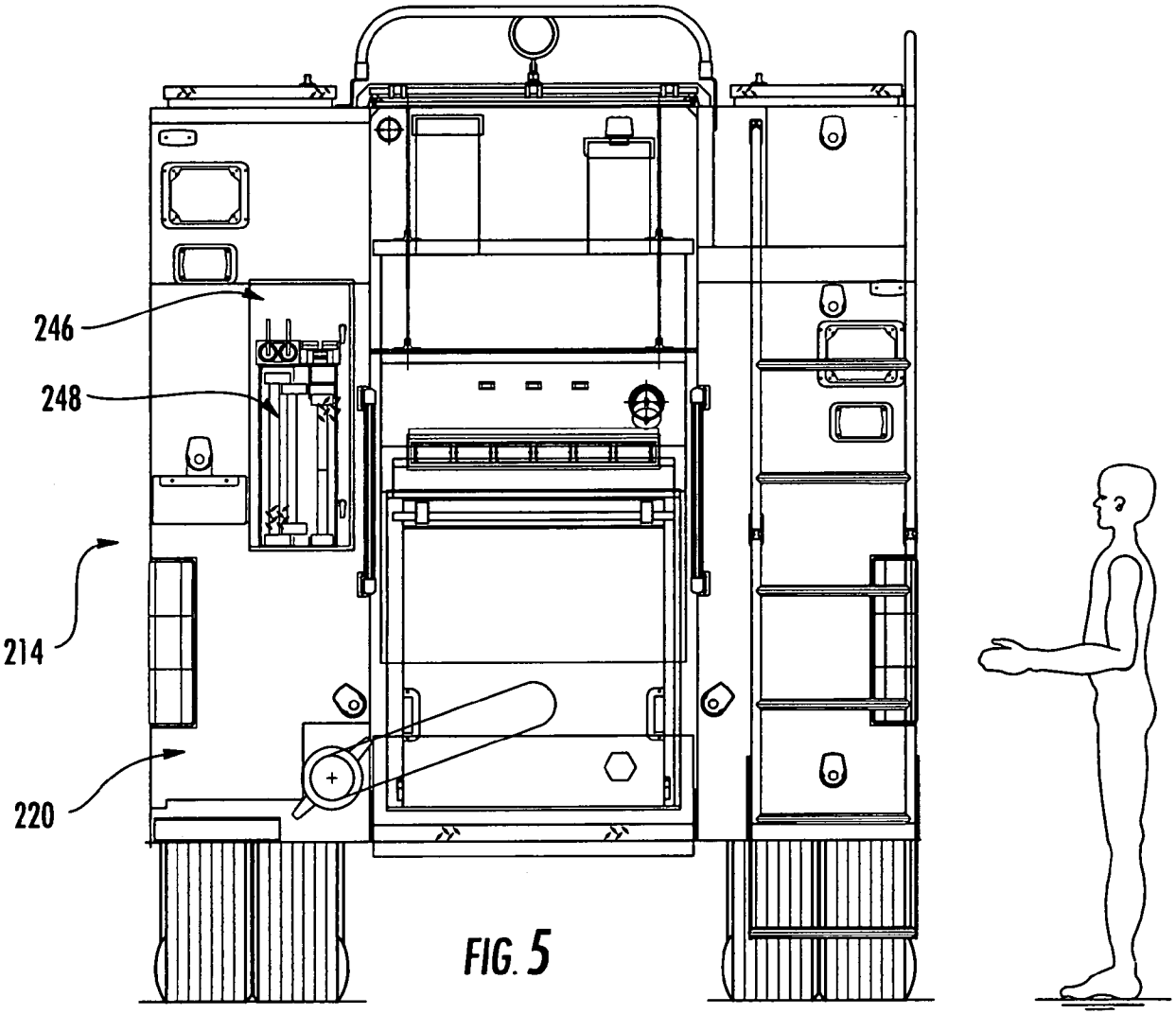
FIG. 5 is a rear elevational view of the firefighting vehicle of FIG. 1.
Figure 6:
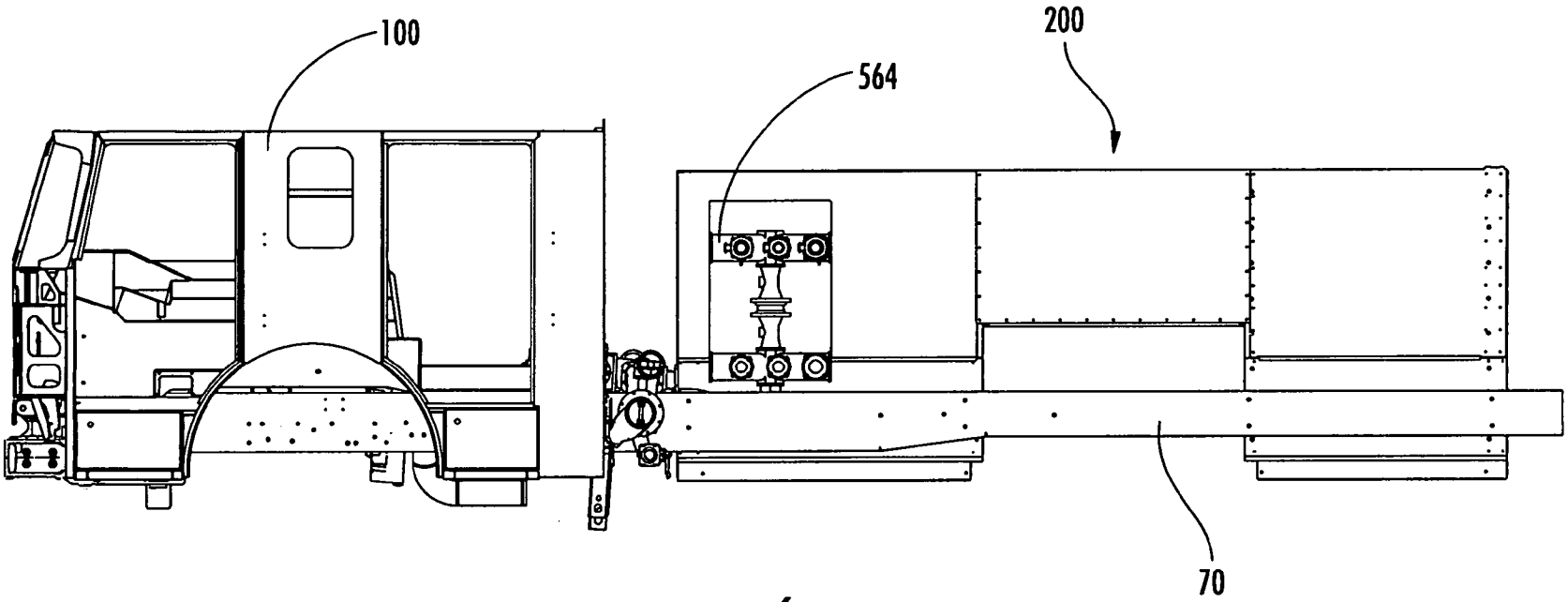
FIG. 6 is a driver side elevational view of a chassis of a firefighting vehicle with a cab of the vehicle shown in a transit position.

Referring to FIG. 5, side panel 220 of rearward compartment 214 is shown according to an exemplary embodiment. Side panel 220 includes an aperture or opening 246 allowing access into body section 206 from the rear of vehicle 50. Opening 246 is shown as being substantially rectangular in shape with a longer side of the rectangular extending in a vertical direction. Opening 246 is configured to receive a ladder 248 intended to be selectively removed from vehicle 50 when needed. Ladder 248 is preferably a collapsible ladder having a collapsed length that may approximately the length of body 200. To accommodate ladder 248, middle compartment 212 and forward compartment 210 include similar openings (not shown) in the side panels so that ladder 248 can be stored therein across all three compartments of body section 206.

As shown in FIG. 1, a forward end of ladder 248 is configured to enter forward compartment 210 when stowed. When stowed, the forward end of ladder 248 is positioned between fire pump control panel 570 and a manifold 564 which is in fluid communication with fire pump system 400. The linkage (e.g., mechanical and/or electrical, etc.) operatively coupling fire pump control panel 570 to manifold 564 is configured such that the forward end of ladder 248 will slide between the linkage without interfering with the operation of the linkage. In conventional firefighting vehicles, the ladder (if stowed within a body portion of the vehicle) is generally stowed along a side opposite the pump control panel. Stowing ladder 248 at the same side as fire pump control panel 570 advantageously allows for increased storage in the side opposite the pump control panel (e.g., right side 62, etc.). According to various alternative embodiments, ladder 248 may be stowed in any of a number of locations on vehicle 50.

FIG. 2 shows side body section 208 according to one exemplary embodiment. The first, second, and third volumes of body section 208 are defined by individual sections shown as a forward compartment 250, a middle compartment 252, and a rearward compartment 254 respectively. Similar to compartments 210, 212 and 214 of body section 206, compartments 250, 252 and 254 generally comprise a floor 256, side panels 258, 260, a top panel 262 and a rear or back panel 264. Compartments 250, 252 and 254 further include one or more covers (e.g., panels, shield, partitions, tarps, etc.), such as doors 266 (shown in retracted positions), that conceal and protect the contents of the respective compartment. Doors 266 may have of a number of suitable configurations (side hinged doors, top hinged door, sliding doors, etc.). According to various alternative embodiments, one or more of doors 266 may be replaced with reciprocating drawers or trays having drawer fronts which conceal and protect the contents when closed.

With fire pump control panel 570 (and possibly ladder 248) located on the driver's side of vehicle 50, compartments 250, 252 and 254 are generally available for the storage of firefighting equipment or anything else to be stored within vehicle 50. Referring to forward compartment 250 in particular, an aperture or opening 256 may be provided along back panel 264 to provide access to a portion of fire pump system 400 positioned between forward compartments 210 and 250 (e.g., pump manifold 564, etc.). Such an opening allows access to this portion of fire pump system 400 without requiring fire pump control panel 570 to be removed from compartment 210 when servicing portions of fire pump system 400.

Vehicle 50 also comprises a firefighting agent storage system which comprises one or more tanks or other containers configured to store one or more firefighting agents such as water, foam, fluid chemicals, dry chemicals and the like. According to an exemplary embodiment, storage system comprises a relatively large water tank (not shown) and a smaller foam tank 282 (shown in FIG. 3). The water tank of the storage system may be configured to hold between approximately 500 gallons of water and approximately 3500 gallons of water, while foam tank 282 may be configured to hold between approximately 10 gallons of a liquid foam concentrate and approximately 300 gallons of the liquid foam concentrate (preferably around 30 gallons of liquid foam). According to an exemplary embodiment, the water tank is a substantially rectangular vessel supported by chassis 70 rearward of cab 100 and between left and right body sections 206 and 208.

The positioning and configuration of fire pump system 400 (detailed below), advantageously enables a larger water tank to be used on vehicle 50 because space that would otherwise be occupied by a pumphouse is now available to receive a larger water tank. According to various alternative embodiments, the storage system may be positioned at other locations of vehicle 50, may have a greater or lesser capacity than those disclosed herein, and may have any of a number of suitable configurations. The positioning and configuration of fire pump system 400, may also advantageously enable vehicle 50 achieve a shorter overall height by using the same size water tank that would be used in a conventional firefighting vehicle. As detailed above, this may allow for storage areas (e.g., hose beds, etc.) to be supported at a lower position.

Figure 7:
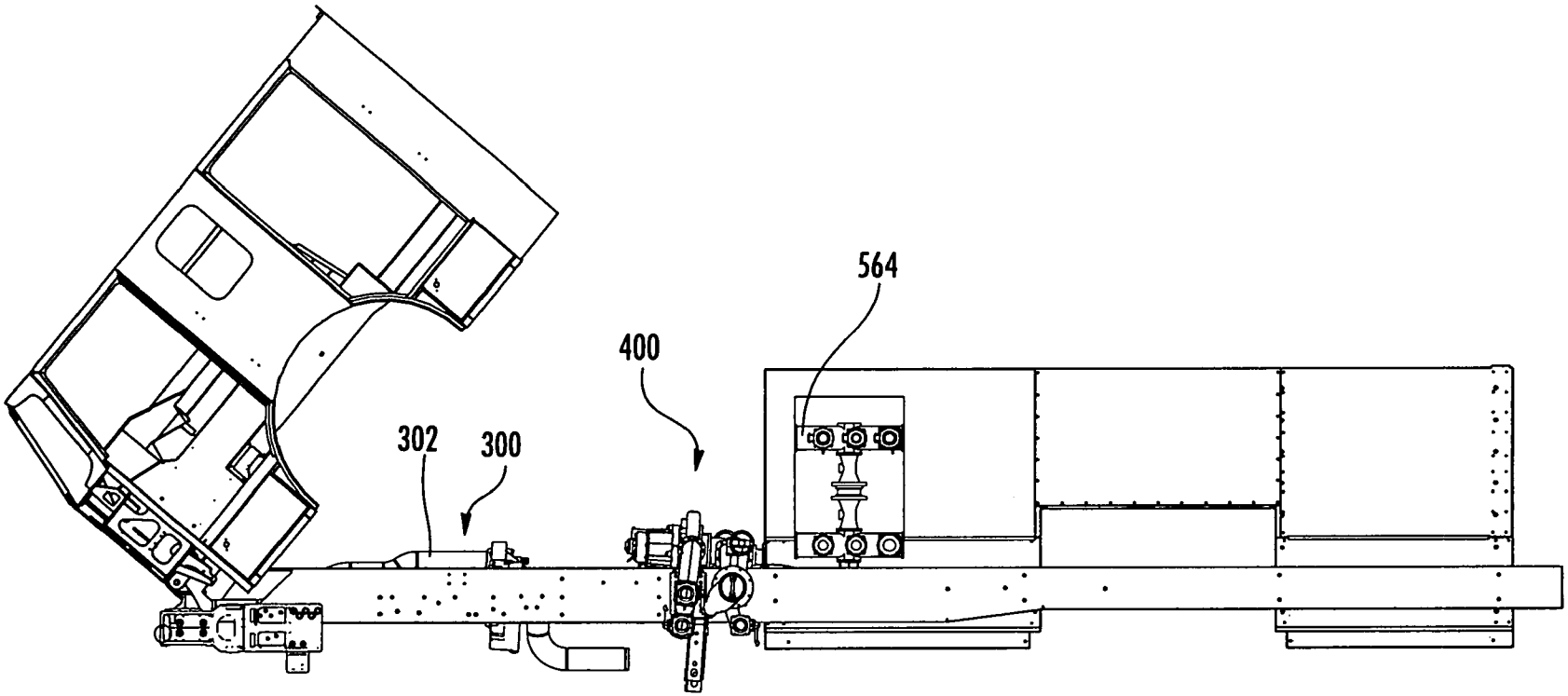
FIG. 7 is a driver side elevational view of the chassis of the firefighting vehicle of FIG. 6 with a cab of the vehicle shown in a service position.
Figure 8:
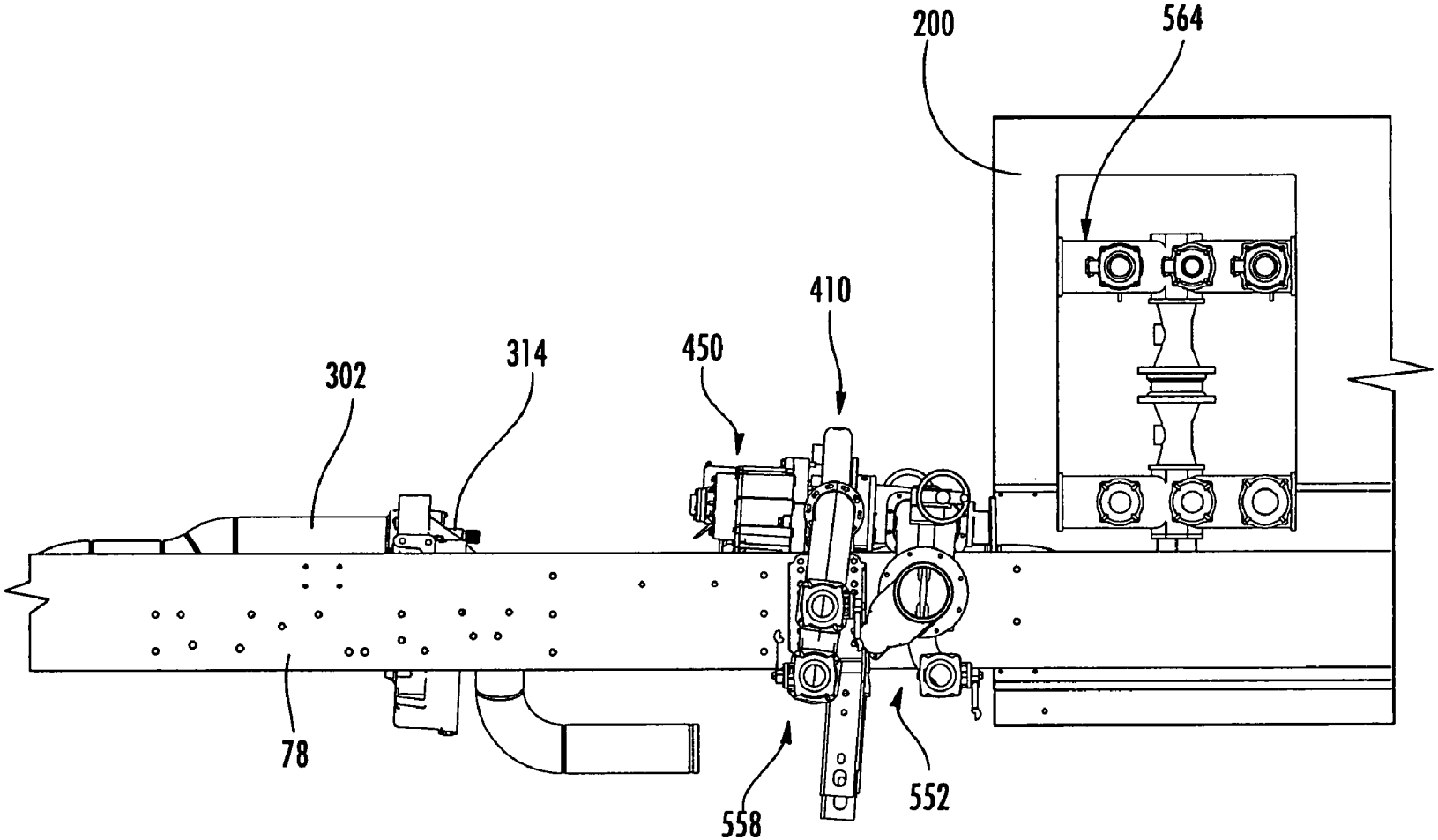
FIG. 8 is a detailed side elevational view of a fire pump system supported by the chassis of the firefighting vehicle of FIG. 6 with the cab in the service position.
Figure 9:
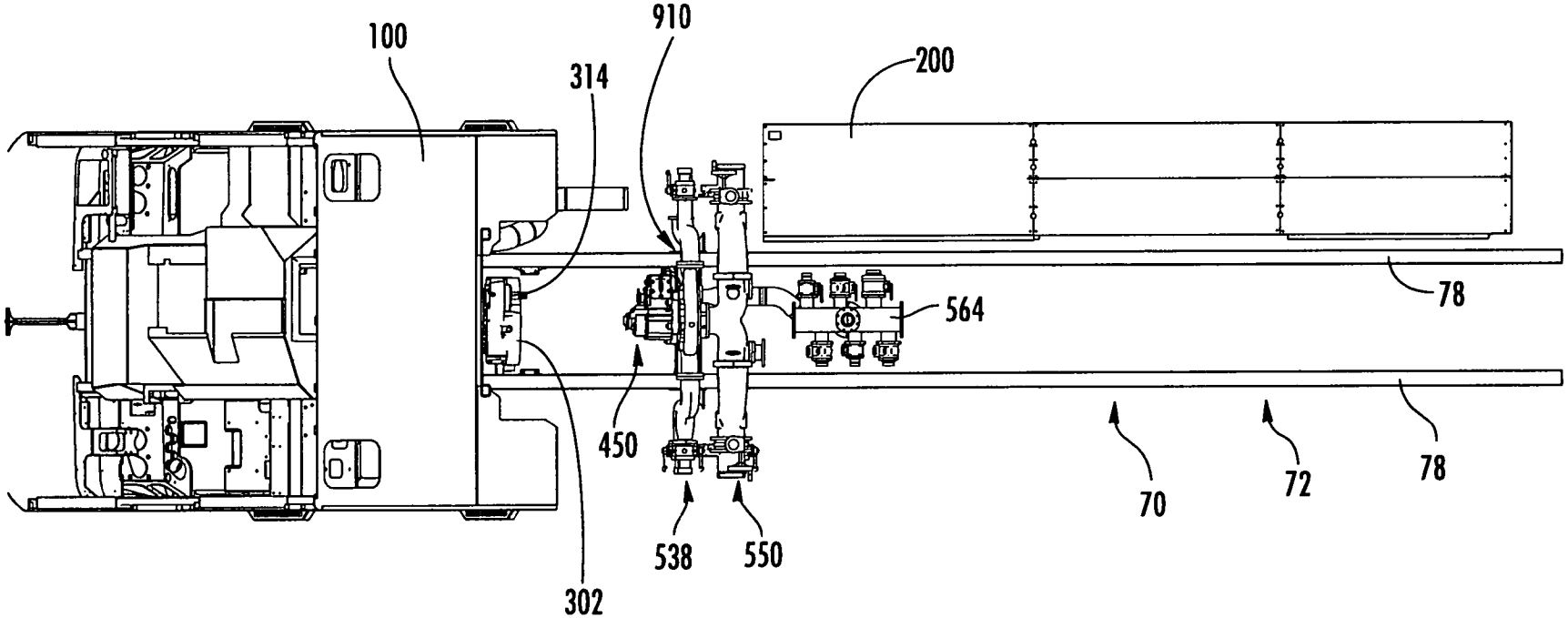
FIG. 9 is a top plan view of the chassis of the firefighting vehicle of FIG. 6 with the cab of the vehicle shown in the service position.

To facilitate the operation of vehicle 50 and components thereof, drive system 300 is provided. Drive system 300 of vehicle 50 provides the power to operate vehicle 50 and certain components of vehicle 50 as well as the structure for transmitting the power to one or more motive members 74, 76 and components of vehicle 50. Referring to FIG. 7, drive system 300 generally comprises a power source or prime mover and a motion transfer device. The prime mover, shown as an engine 302, generally comprises a source of mechanical energy (e.g., rotational movement, etc.) which is derived from an energy source (e.g., a stored energy source, etc.). Examples of suitable prime movers include, but are not limited to, an internal combustion gas-powered engine, a diesel engine, a turbine, a fuel cell driven motor, an electric motor or any other type of motor capable of providing mechanical energy.

Any of the just-mentioned prime movers may be used alone or in combination with one or more additional power sources (as in a hybrid vehicle) to provide mechanical energy. According to one exemplary embodiment, engine 302 is an internal combustion engine. According to various alternative embodiments, the prime mover may be selected from any suitable prime mover that is, or may become, commercially available, or the prime mover may be specifically configured for use with vehicle 50.

Figure 12:
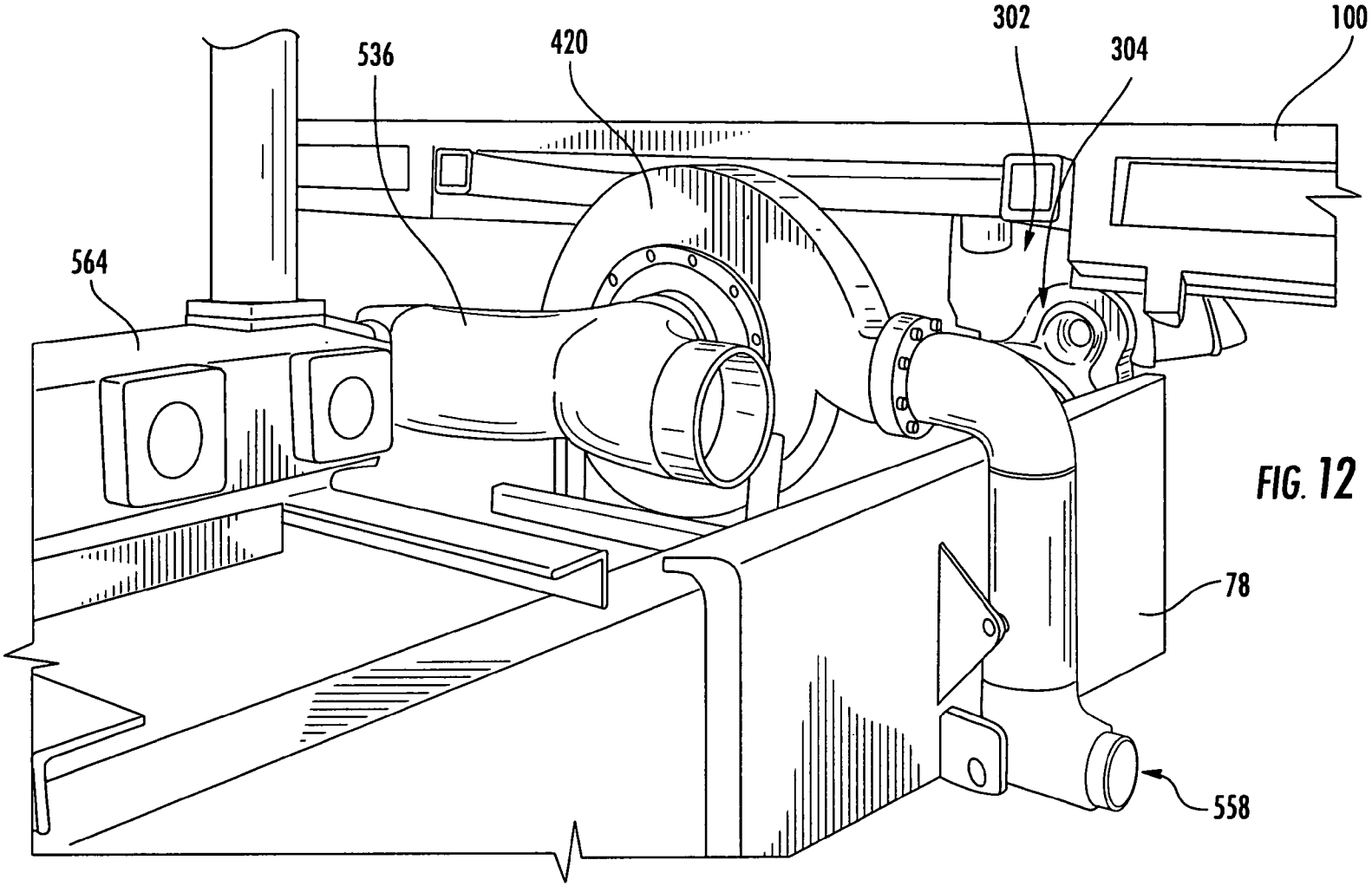
FIG. 12 is a photograph of a rear portion of a fire pump system supported by a chassis of a firefighting vehicle.
Figure 13:
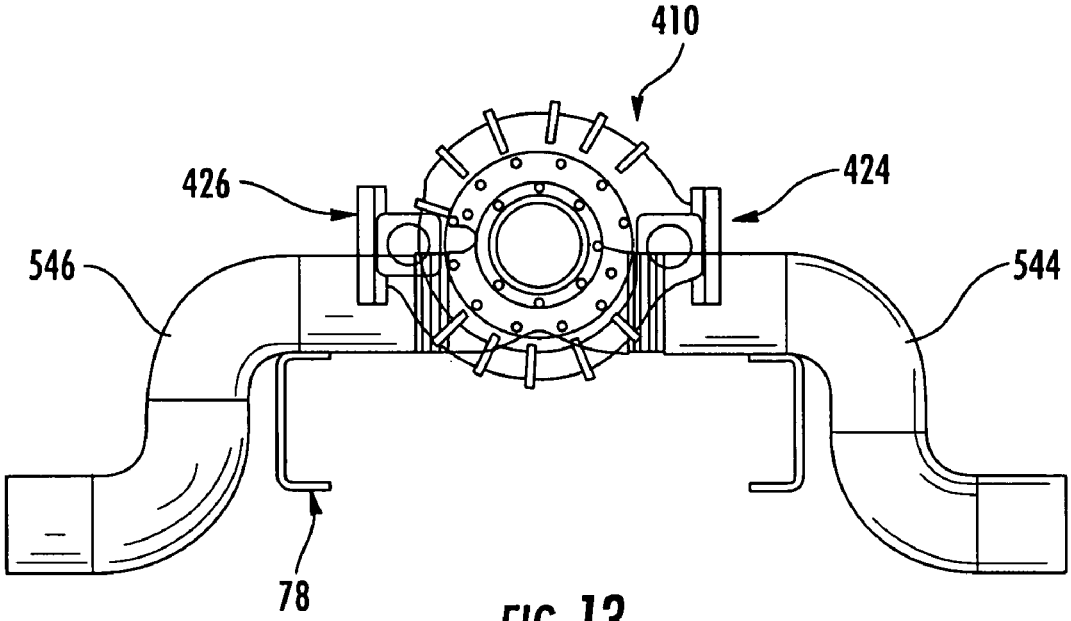
FIG. 13 is a rear view of a fire pump system supported by a chassis of a firefighting vehicle.

The motion transfer device, shown as a transmission 304 in FIG. 12, is coupled to a first power output of engine 302 and ultimately (in combination with other components) transfers the power and rotational mechanical energy received from engine 302 to rear motive members 76, which in turn propel vehicle 50 in a forward or rearward (or other) direction. Transmission 304 may be coupled, directly or indirectly, to motive members 76, a wheel end reduction unit, and/or a series of motion transferring devices such as shafts, joints, differentials, etc. that are coupled together to transfer the power or energy provided by engine to motive members 76.

Engine 302 is shown as being supported at front portion of chassis 70. Engine 302 is supported within cavity 82 defined by frame rails 78 and under cab 100. Engine 302 comprises a main body or casing 306, a first power output (shown as a crankshaft 308), and a flywheel 310 operatively coupled to crankshaft 308 at a rear portion of engine casing 306. When mounted to chassis 70, the rear portion of engine casing 306 faces in the rearward direction of vehicle 50. Engine 302 (via flywheel 310) is closely connected to transmission 304 having an output shaft (not shown) which extends in a rearward direction toward a rear portion of vehicle 50 to at least power the rear motive members 76. Transmission 304 may be any of a variety of suitable transmissions (e.g., standard, split shaft, etc.). According to one exemplary embodiment, transmission 304 is an automatic transmission. The combination of engine 302 and transmission 304 is at least partially supported beneath cab 100.

According to an exemplary embodiment, engine 302 further comprises a second power output 312. Second power output 312 is configured to provide rotational mechanical energy whenever engine 302 is providing rotational mechanical energy. According to the embodiment illustrated, second power output 312 is a power take-off device supported at or proximate to a rear portion of engine casing 306. Such device is referred to generally herein as a rear engine power take-off device 314 (REPTO) device. Rear engine power take-off device 314 is a drive which comprises a source of rotational energy (secondary to crankshaft 308) for operating one or more components of vehicle 50. Rear engine power take-off device 314 generally includes a main body or casing 316, a gear set (not shown) operatively coupled to a rear portion of crankshaft 308 before transmission 304, and an output shaft 318 outwardly extending in a rearward direction. Unlike a power take-off device coupled to a split shaft transmission, rear engine power take-off 314 operates whenever engine 302 is operating. In addition, rear engine power take-off 314 may be able to output higher torques than a power take off device operatively coupled to a transmission.

Rear engine power take-off 314 may have any of a number of configurations. According to an exemplary embodiment, casing 306 is an integral part of a housing supporting flywheel 310. In such an embodiment, rear engine power take-off 314 is operatively coupled between engine 302 and transmission 304. Coupling rear engine power take-off device 314 between engine 302 and transmission 304 (as opposed to coupling the power take-off device after transmission 304) may allow for a power take-off device with a higher power output.

Figure 11:
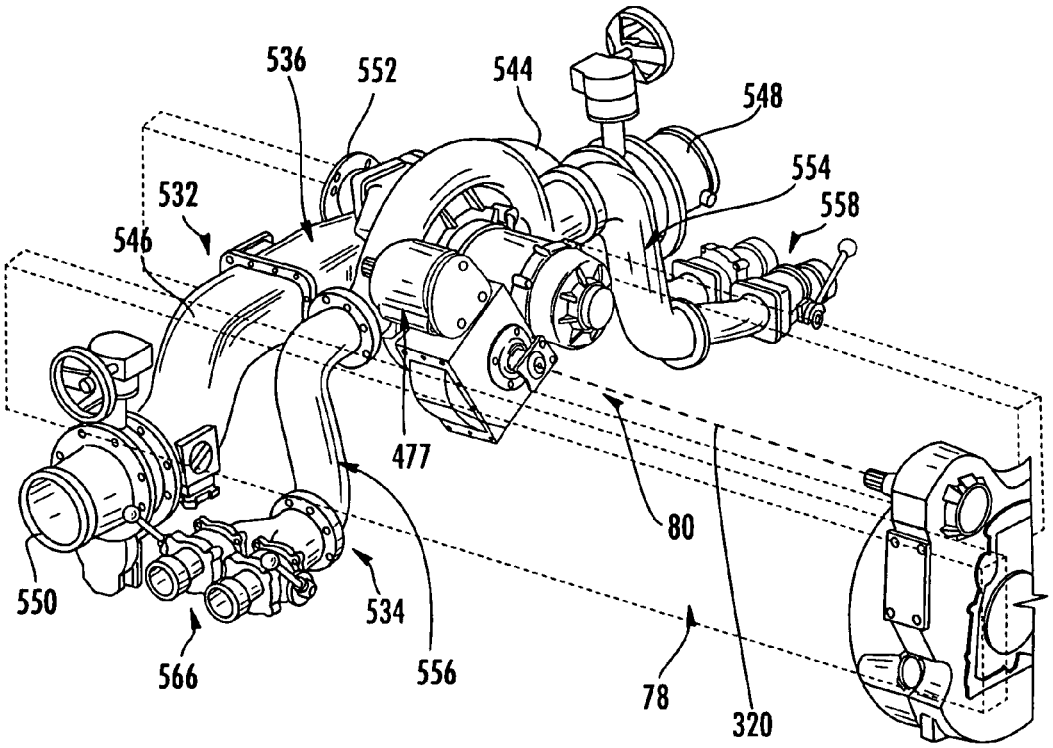
FIG. 11 is a perspective view of a front portion of a fire pump system supported by a chassis of a firefighting vehicle.

According to the embodiment illustrated, rear engine power take-off device 314 is used to drive fire pump system 400. To provide for this, vehicle 50 additionally includes a fire pump drive line 320 extending between a first end 322 originating at output of the rear engine power take-off and a second end 324, terminating at fire pump system 400. As shown by FIG. 11, fire pump drive line 320 generally extends along a line that is slightly offset from and parallel to a longitudinal center line of vehicle 50 between frame rails 78. Due to the positioning of fire pump system 400 at least partially under a rear portion of cab 100, the overall length of fire pump drive line 320 can advantageously be reduced. For example, fire pump drive line 320 may have a length between approximately 18 inches and approximately 40 inches. According to one exemplary embodiment, fire pump drive line 320 has a length that is approximately 24 inches. Reducing the length of fire pump drive line 320 may free up space along chassis 70 that would otherwise be occupied by a shaft or axle defining drive line 320 and extending to the mid or rear portion of the vehicle.

Referring to FIGS. 6 through 18, fire pump system 400 is a fluid pumping system configured to pressurize and pump the firefighting agent from a firefighting agent source (e.g., tank, body of water, hydrant, etc.) so that the pressurized firefighting agent can be supplied to various fluid outlets (e.g., hose connectors, manifolds, turrets, etc.) of vehicle 50. According to an exemplary embodiment, fire pump system 400 is configured to pump at least 500 gallons of firefighting agent per minute and up to at least about 2,000 gallons of firefighting agent per minute. According to various alternative embodiments, fire pump system 400 may have flow rates greater or less than those provided above. Fire pump system 400 generally comprises a fire pump 410, a fire pump gear case 450, a fluid routing system 530 and fire pump control panel 570.

Figure 15:
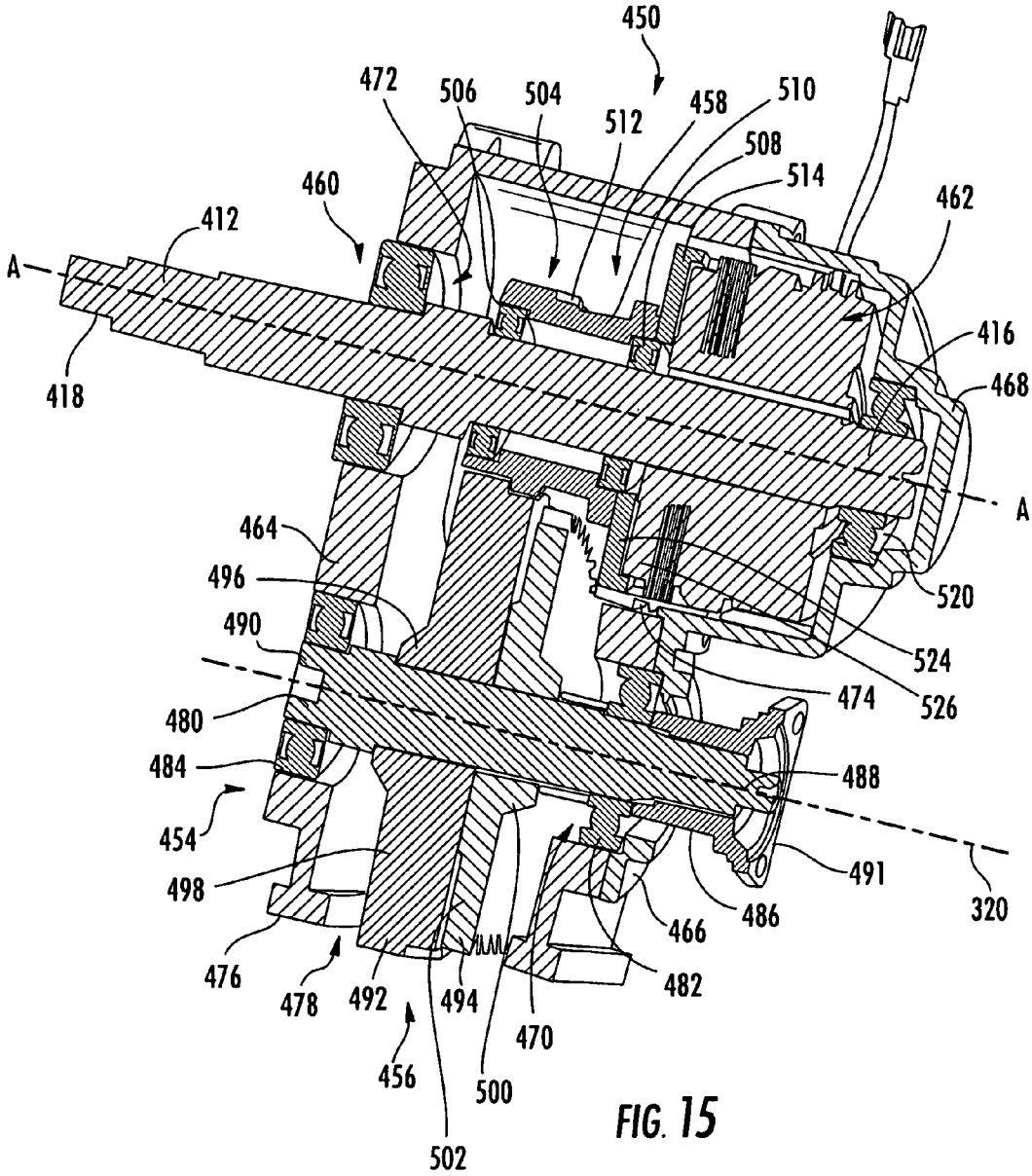
FIG. 15 is cross-sectional view of the gear case of FIG. 14 taken along line 15-15.

According to an exemplary embodiment, fire pump 410 comprises a shaft (e.g., axle, pump shaft, etc.), shown in FIG. 15 as an impeller shaft 412, an impeller (not shown), and a main body or pump housing 414. Impeller shaft 412 is an elongated, cylindrical member that is rotatably supported at pump housing 414 for rotation about an axis A-A. Impeller shaft 412 includes a first end or portion 416 and a second end or portion 418. First portion 416 of impeller shaft 412 outwardly extends from pump housing 414 (e.g., a front portion of pump housing 414, etc.) and is configured to be operably coupled to a source of rotational mechanical energy.

While impeller shaft 412 may be operably coupled to any suitable source of rotational mechanical energy, according to an exemplary embodiment, first portion 416 of impeller shaft 412 is operatively coupled to rear engine power take-off device 314. As detailed below, impeller shaft 412 may be operably coupled directly or indirectly (through a suitable gear configuration) to fire pump drive line 320 and/or rear engine power take off device 314. According to various alternative embodiments, impeller shaft 412 may be configured to be operatively coupled to an output of transmission 304 (e.g., a power take off device operatively coupled to a split shaft transmission, etc.).

Second portion 418 of impeller shaft 412 is configured to support the pump impeller. The pump impeller includes a generally cylindrical hub lying along an impeller axis. The impeller axis is generally coaxial with impeller shaft axis A-A. The impeller hub is adapted to be coupled to impeller shaft 412 which drives the pump impeller to rotate about the impeller axis in a circumferential rotation direction. The impeller hub may be coupled to impeller shaft 412 using any of a variety of suitable manner (e.g., spline, keyed, bolted, welded, press-fit, etc.). The pump impeller further comprises one or more vanes extending radially outwardly from the hub to define a periphery of the pump impeller. The vanes are configured to direct a fluid entering fire pump 410 and may have any of a variety of suitable configurations.

Impeller shaft 412 and the pump impeller are rotatably supported by pump housing 414. To facilitate this, pump housing 414 generally includes an annular impeller chamber (the inside of which is not shown) which encloses the pump impeller. The impeller chamber is sized to receive the pump impeller with sufficient clearance to allow for the rotation of the pump impeller. An inlet chamber (not shown) is provided at a front end of the impeller chamber. The inlet chamber includes a first or front end configured to receive the firefighting agent and a second or rear end that is in fluid communication with the impeller chamber. The rear end of the inlet chamber is configured to direct the firefighting agent flowing through the inlet chamber towards a central portion of the pump impeller (e.g., the hub of the pump impeller, etc.).

Defining the impeller chamber is a volute 420. Volute 420 is formed of the inner walls of the impeller chamber and has a scroll-like shape which provides a surface for channeling the firefighting agent out of the impeller chamber after being deflected or otherwise agitated by the vanes of the pump impeller. As detailed below, volute 420 includes one or more fluid outlets (e.g., discharge ports, etc.) through which the firefighting agents is discharged.

To facilitate the movement of the firefighting agent, pump housing 414 further includes one or more inlets (e.g., suction ports, openings, etc.) configured to receive the firefighting agent and one or more outlets (e.g., exit openings, discharge ports, etc.) configured to discharge a pressurized firefighting agent. The one or more inlets and outlets may have any of a variety of diameters and/or locations depending on various design criteria, including the particular application, the desired flow rate, etc.

According to an exemplary embodiment, fire pump 410 is an end suction pump including a single fluid inlet 422 and a pair of fluid outlets (shown as a first fluid outlet 424 and a second fluid outlet 426). According to various alternative embodiments, fire pump 410 may be a double suction pump, a radial suction pump, or any other pump capable of being fitted beneath cab 100. Fluid inlet 422 directs a firefighting agent passing therethrough towards the hub of the pump impeller in a direction that is generally parallel to the impeller axis and impeller shaft axis A-A. Once the firefighting agent enters through fluid inlet 422, pump housing 414 comprises suitable conduits, passageways, waterways, chambers, or the like (e.g., the inlet chamber, the impeller chamber, etc.) so that in the operation of fire pump 410 and rotation of the pump impeller, the firefighting agent flows through pump housing 414 from fluid inlet 422 to fluid outlets 424, 426. Low pressure firefighting agent entering fire pump 410 through fluid inlet 422 is converted by the rotation of the pump impeller and the configuration of the passageways within pump housing 414 to high pressure firefighting agent discharged at first fluid outlet 424 and second fluid outlet 426.

First fluid outlet 424 is provided on one side of pump housing 414 (e.g., a left side) and second fluid outlet 426 is provided on the opposite side of pump housing 414 (e.g., a right side). As detailed below, one or more conduits and ultimately hose connectors are coupled to each fluid outlet to provide a discharge port on each side of vehicle 50. Providing pump housing 414 with a pair of outlets advantageously allows the firefighting agent to be discharged from various locations without the need for significant plumbing or additional bulky passageways within the pump housing to direct the fluid. According to an exemplary embodiment, first fluid outlet 424 and second fluid outlet 426 are provided along volute 420 so that both outlets are in direct fluid communication with the impeller chamber.

Depending upon the particular application, a single volute 420 may be used to direct fluid from the impeller to outlets 424 and 426. The use of a single volute 420 can provide fluid pressure, flow rate, and/or overall size advantages depending upon the combination of flow requirements from outlets 424 and 426. Alternatively, there may be flow requirements for outlets 424 and 426 where it would be desirable to provide two volutes, wherein a first volute directs fluid flow from the impeller to outlet 424 and a second volute directs flow from the impeller to outlet 426.

Figure 10:
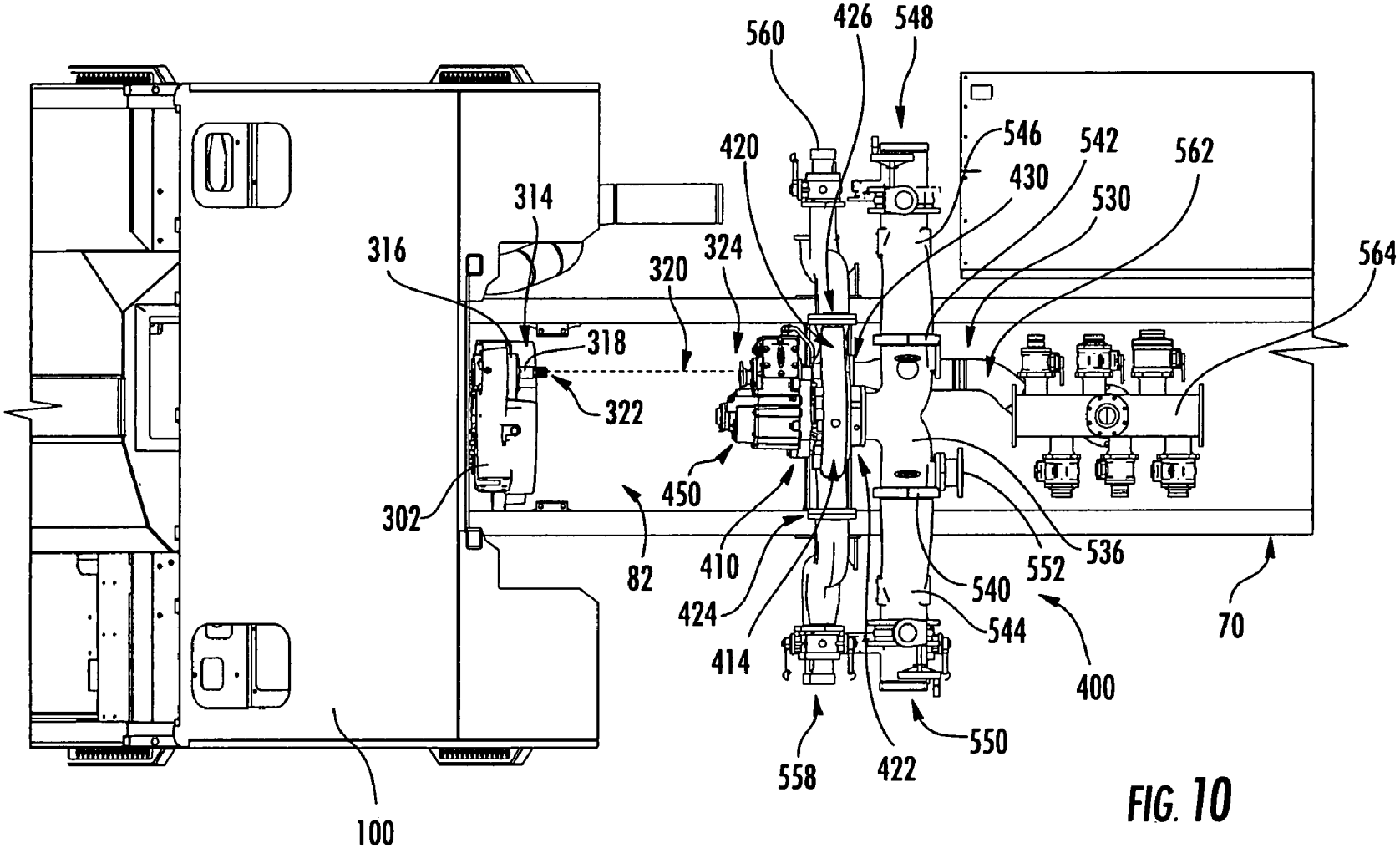
FIG. 10 is a detailed top plan view of a fire pump system supported by the chassis of the firefighting vehicle of FIG. 6 with the cab in the service position.

As best shown in FIG. 10, pump housing 414 is further shown as including an auxiliary fluid outlet 430 provided at a rear end of pump housing 414 and facing a direction that is substantially perpendicular to the other two fluid outlets (i.e., first fluid outlet 424 and second fluid outlet 426). Auxiliary fluid outlet 430 provides a secondary fluid passageway to other areas of the vehicle (e.g., a turret, a water tank, a manifold stack, etc.) rearward of first fluid outlet 424 and second fluid outlet 426. For example, auxiliary fluid outlet 430 is shown to be in fluid communication with manifold 564. Auxiliary fluid outlet 430 is in fluid communication with the impeller chamber (either directly or indirectly) and, similar to the other two fluid outlets, allows the amount of plumbing used to direct the firefighting agent about vehicle 50 to be reduce.

As detailed above, pump housing 414 is supported by chassis 70 under a rear portion of cab 100. To facilitate supporting pump housing 414 in such a position, one or more cross members 80 may be used. As best shown in FIG. 11 (wherein a cross member 80 is shown in phantom lines), pump housing 414 is shown being supported at least in part by cross member 80. Pump housing 414 may be directly or indirectly mounted to cross member 80. According to various alternative embodiments, more than one cross member 80 may be used to provide a cradle-like support for pump housing 414.

Figure 18:
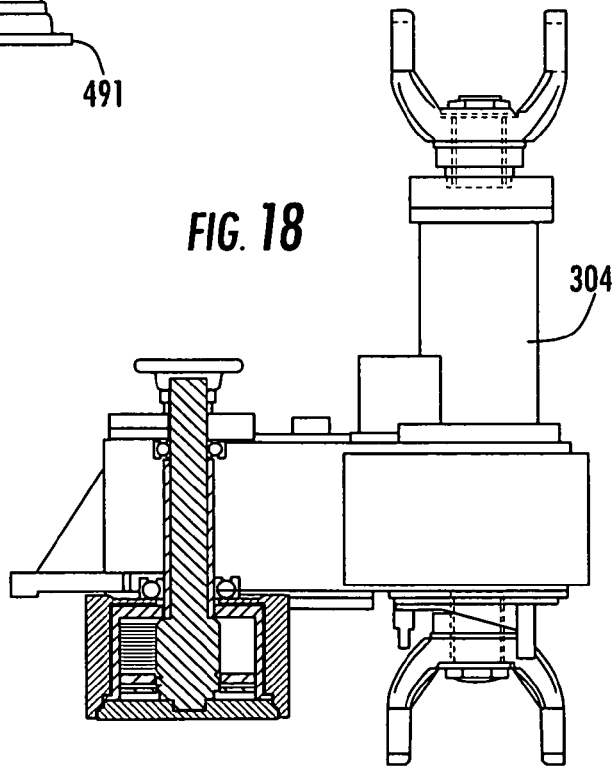
FIG. 18 is cross-sectional view of the impeller shaft and the clutch assembly of FIG. 16 provided in conjunction with a split shaft transmission.

To facilitate the operation of fire pump system 400, impeller shaft 412 is operatively coupled to a source of rotational energy. According to an exemplary embodiment, impeller shaft 412 is operatively coupled to drive system 300, and particularly to rear engine power take-off device 314. Operatively coupling impeller shaft 412 to rear engine power take-off device 314 may reduce or eliminate pump shift issues not uncommon with midship pumps coupled to a transmission. According to various alternative embodiments, fire pump system 400 may be driven by any other suitable source of rotational energy including, but not limited to, a secondary motor or a power take-off (PTO) device coupled to the transmission (as shown in FIG. 18).

To facilitate the coupling of impeller shaft 412 to rear engine power take-off device 314, fire pump gear case 450 is provided. Gear case 450 is a gearbox configured to transfer the rotational mechanical energy of rear engine power take-off device 314 to impeller shaft 412. Gear case 450 may have any of a number of configurations suitable for transferring a source of rotational mechanical energy to impeller shaft 412. According to an exemplary embodiment, gear case 450 is configured so that impeller shaft 412 may be selectively disengaged (e.g., disconnected, declutched, etc.) from rear engine power take-off device 314. Since rear engine power take-off device 314 operates whenever engine 302 is operating, gear case 450 is configured so that impeller shaft 412 may be selectively coupled to or decoupled from rear engine power take-off device 314 depending on whether operation of fire pump 410 is desired. Fire pump gear case 450 generally includes a main body or housing assembly 452, an input assembly 454, a drive gear assembly 456, a driven gear assembly 458, an output assembly 460, and a clutch assembly 462.

Housing assembly 452 is an assembly of components that form a rigid, generally enclosed structure within which the various components of fire pump gear case 450 are coupled and/or mounted. According to the embodiment illustrated, housing assembly 452 includes a main housing 464, a first cover 466, and a second cover 468. Main housing 452 is a rigid structure that is supported by chassis 70. To facilitate supporting of main housing 452 by chassis 70, at least one cross member 80 extends laterally between the frame rails 78. The same cross member 80 used to support pump housing 414 may also be used to support main housing 452 of gear case 450. To facilitate coupling main housing 452 to chassis 70, main housing 452 includes a series of spaced apart apertures configured to receive a suitable fastener (e.g., bolts, rivets, clips, etc.).

Figure 14:
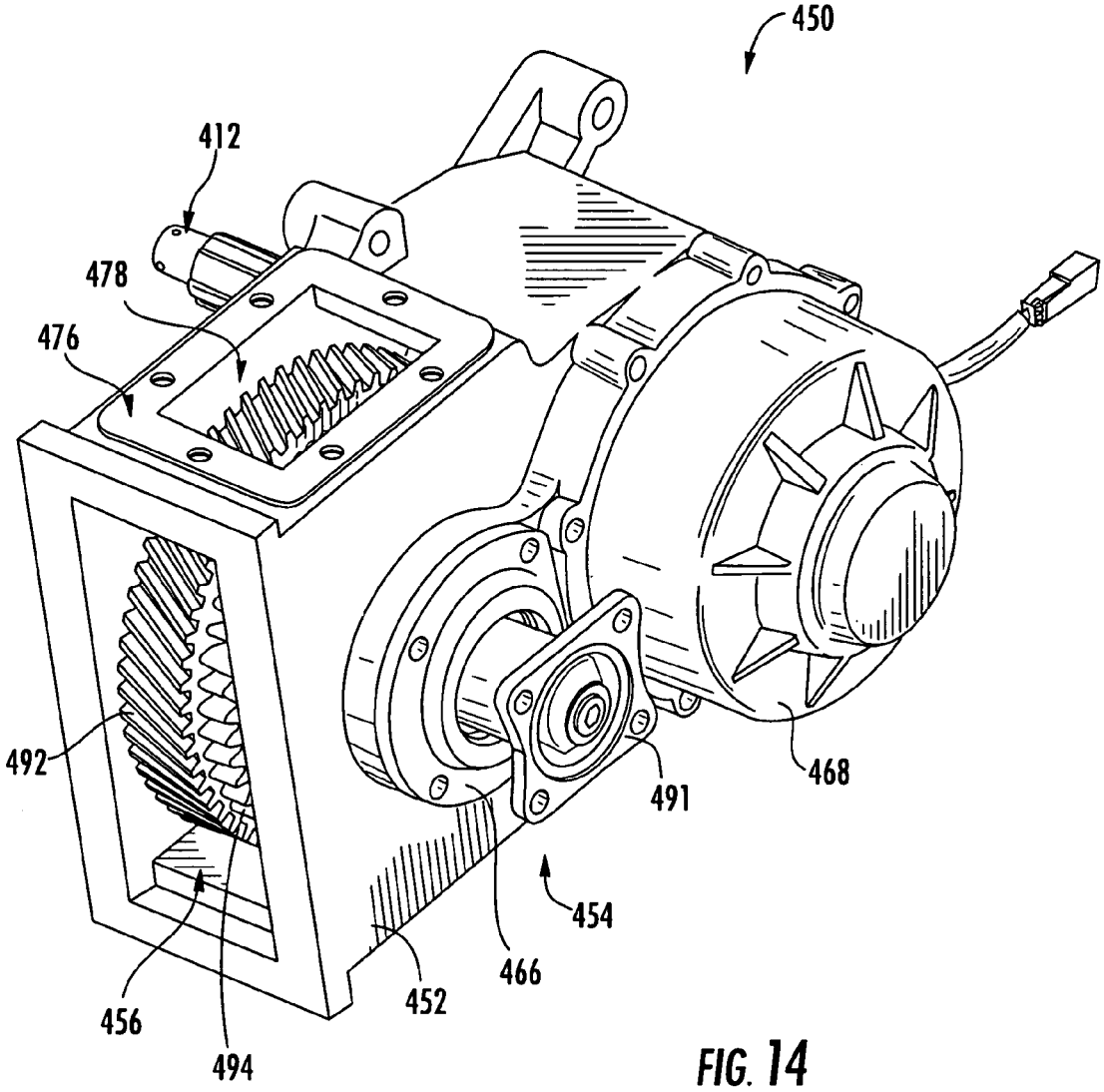
FIG. 14 is a perspective view of a front portion of a gear case of the fire pump system of FIG. 11.

Main housing 452 defines a first opening 470 through which a portion of input assembly 454 extends and a second opening 472 through which a portion of output assembly 460 extends. Main housing 452 also includes a third opening 474 through which clutch assembly 462 and a portion of output assembly 460 can be installed and/or removed relative to main housing 452. First cover 466 is coupled to first opening 470 and includes an opening for receiving and supporting a portion of input assembly 454. Second cover 468 is coupled to third opening 474 and provides an enclosure for clutch assembly 462. To facilitate coupling first cover 466 and second cover 468 to main housing 452, first cover 466 and second cover 468 are shown in FIG. 14 as including a series of spaced apart apertures configured to receive a suitable fastener (e.g., bolts, rivets, clips, etc.).

Main housing 452 is further shown as including an auxiliary pad 476 defining a fourth opening or access window 478. Auxiliary pad 476 and access window 478 are provided along an upper surface of main housing 452. Access window 478 is a generally rectangular opening provided in main housing 452 that is intended to provide access to the interior or main housing 452. Access window 478 allows a gear from drive gear assembly 456 to engage a gear from or operatively coupled to an auxiliary device such as a power take-off device. Surrounding access window 478 is auxiliary pad 476. Auxiliary pad 476 is a pad or receiving structure that is configured to provide a surface or structure that is suitable to receive a portion of the auxiliary device intended to be coupled thereto. The surface of auxiliary pad 476 is shown as being a substantially flat surface. To facilitate coupling the auxiliary device to auxiliary pad 476, auxiliary pad 476 includes a series of spaced apart apertures configured to receive a suitable fastener (e.g., bolts, rivets, clips, etc.).

According to an exemplary embodiment, auxiliary pad 476 and access window 478 are configured to a standard power take-off device (shown as a PTO device 477 in FIG. 11) of a type that would typically be mounted to a vehicle transmission. PTO device 477 provides an additional drive that can be used to power one or more systems (e.g., a compressor of a CAFS, a generator, etc.). Similar PTO devices may be operatively coupled to transmission 304.

According to various alternative embodiments, auxiliary pad 476 and access window 478 may assume any one of a variety of different configurations. For example, the access window may have a shape different than a rectangular. Further, the surface of the auxiliary pad may include a projection, recess, flange, or any other configuration that may assist in mounting an auxiliary device. The auxiliary pad may also include features that facilitate the coupling of an auxiliary device to the auxiliary pad, such as posts, nuts, studs, or one or more of a variety of other fastening devices. Further still, the auxiliary pad and the access opening may be provided at a position other than the upper surface of main housing 452 (e.g., a side surface, a bottom surface, etc. Even further still, more than one auxiliary pad and access window may be provided in main housing 452.

According to still further alternative embodiments, auxiliary pad 476 and access window 478 may be eliminated if gear case 450 is not configured to power an auxiliary device in addition to fire pump system 400. For example, gear case 450 may only include a gear configuration which only powers fire pump system 400 (e.g., drive gear assembly 456 consists of a single gear, etc.).

Referring further to FIG. 15, input assembly 454 comprises a input shaft 480 (defining fire pump drive line 320), a first bearing 482, a second bearing 484, and a sleeve 486. Input shaft 480 is an elongated, cylindrical member or axle that is received within main housing 452. Input shaft 480 extends between a first end 488 and a second end 490. First end 488 of input shaft 480 outwardly extends through first opening 470 and is configured to be coupled to a power output such as rear engine power take-off device 314. First and second bearings 482, 484 are coupled between input shaft 480 and main housing 452 such that the inner diameter of the bearings receive input shaft 480 and the outer diameter of the bearings are received by main housing 452.

At least partially enclosing first end 488 is sleeve 486. Sleeve 486 is positioned outside of main housing 452 and is configured to protect input shaft 480. A flange portion 491 extending radially outwardly from sleeve 486 and is configured to be coupled to a shaft assembly extending from rear engine power take off device 314. To facilitate the coupling of flange portion 491 to such a shaft assembly, flange portion 491 includes a series of spaced apertures configured to receive a suitable fastener.

Second end 490 of input shaft 476 is configured to support drive gear assembly 456. Drive gear assembly 456 transfers the rotational movement of input shaft 480 to drive various components of the vehicle 50. According to the embodiment illustrated, drive gear assembly 456 comprises a first drive gear 492 and a second drive gear 494. First drive gear 492 is configured to transfer the rotational movement of input shaft 476 to fire pump 410. Second drive gear 494 is configured to transfer the rotational movement of 476 input shaft to an auxiliary device such as a power take-off device. According to various alternative embodiments, the second drive gear (and thus the secondary or auxiliary drive) may be eliminated from drive gear assembly 456. According to a further alternative embodiment, more than one auxiliary drive may be included in drive gear assembly 456.

According to an exemplary embodiment, first drive gear 492 is a helical gear that includes a shaft portion 496 and a gear portion 498. Shaft portion 496 is a cylindrical member or sleeve that is configured to be coupled to input shaft 476 such that rotation of input shaft 476 causes rotation of first drive gear 492. Gear portion 498 of first drive gear 492 extends radially outward from shaft portion 496 and includes helical teeth (not shown) that engage driven gear assembly 458. Second drive gear 494 is a spur gear that includes a shaft portion 500 and a gear portion 502. Shaft portion 500 is a cylindrical member or sleeve that is configured to be coupled to input shaft 476 (coaxial with first drive gear 492) such that rotation of input shaft 476 causes rotation of second drive gear 494. Gear portion 502 of second drive gear 494 extends radially outward from the shaft portion and includes substantially straight teeth configured to engage a corresponding gear of an auxiliary device.

Driven gear assembly 458 engages first drive gear 492 of drive gear assembly 456 and transfers the rotational movement of drive gear assembly 456 to clutch assembly 462. According to the embodiment illustrated, driven gear assembly 458 comprises a driven gear 504, a first bearing 506, and a second bearing 508. Driven gear 504 is a helical gear that includes a shaft portion 510, a gear portion 512, and a clutch engaging portion 514. Shaft portion 510 is an elongated, cylindrical member or axle that extends from gear portion 512 to clutch engaging portion 514. Clutch engaging portion 514 is configured to selectively engage clutch assembly 462 to transfer the rotational energy of driven gear 504 to clutch assembly 462 and subsequently to output assembly 460 (e.g., impeller shaft 412, etc.). Clutch engaging portion 514 includes an annular recess 516 that receives second bearing 508, which in turn receives a portion of output assembly 460. Gear portion 512 extends radially outward from shaft portion 510 and includes helical teeth (not shown) that engage the helical teeth of first drive gear 492. Gear portion 512 includes an annular recess 518 that receives first bearing 506, which in turn receives a portion of output assembly 460.

Output assembly 460 comprises an output shaft (i.e., impeller shaft 412), a first bearing 520, and a second bearing 522. First end 416 of impeller shaft 412 (i.e., an end opposite the pump impeller) is received within first bearing 506 and second bearing 508 of driven gear assembly 458 such that impeller shaft 412 and driven gear 504 can rotate independently of one another. Second end 418 of impeller shaft 412 outwardly extends through second opening 472 in main housing 452, while first end 416 of impeller shaft 412 is coupled to a portion of clutch assembly 462. Second bearing 522 is coupled between impeller shaft 412 and main housing 452.

First end 416 of impeller shaft 412 is coupled to a portion of clutch assembly 462 such that impeller shaft 412 rotates along with the portion of clutch assembly 462. A friction reducing device, shown as first bearing 520 is coupled between first portion 416 of impeller shaft 412 and second cover 468 such that the inner diameter of first bearing 520 receives impeller shaft 412 and the outer diameter of first bearing 520 is received by second cover 468.

Figure 16:
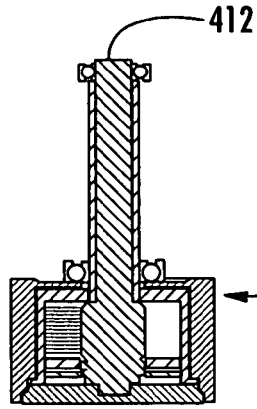
FIG. 16 a cross-sectional view of an impeller shaft and a clutch assembly according to an exemplary embodiment.
Figure 17:
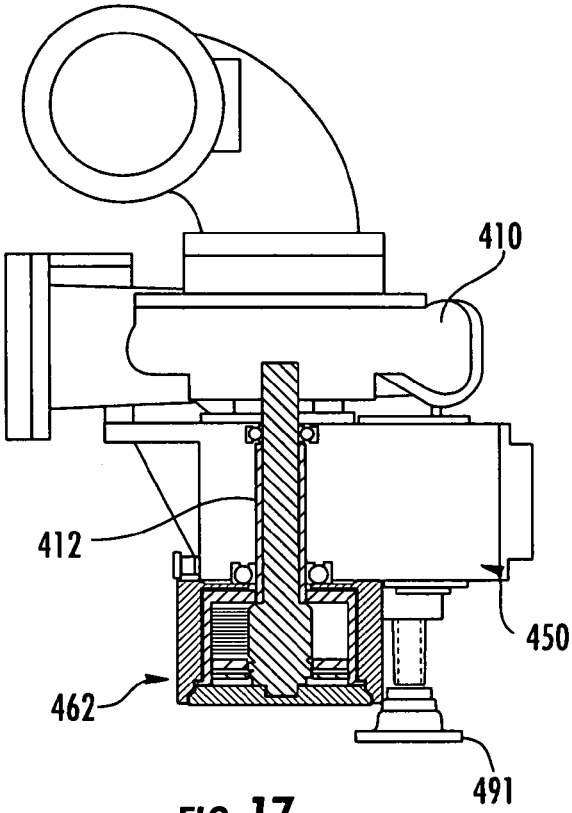
FIG. 17 is cross-sectional view of the impeller shaft and the clutch assembly of FIG. 16 provided in conjunction with a rear-engine power take-off device.

Referring to FIG. 16, clutch assembly 462 is a multi-plate clutch that selectively controls the rotational movement that is transferred from driven gear assembly 458 to impeller shaft 412. Referring back to FIG. 15, clutch assembly 462 generally comprises an input portion 524 and an output portion 526. Input portion 524 is coupled to clutch engaging portion 514 of driven gear 504 and rotates with driven gear 504 around the same axis as impeller shaft 412 (i.e., axis A-A). Output portion 526 is selectively engageable with input portion 524 and is coupled to first end 416 of impeller shaft 412. Output portion 526 may be coupled to first end 416 of impeller shaft 412 using any of a variety of suitable manner (e.g., spline, keyed, bolted, welded, press-fit, integrally formed, etc.).

To the extent to which the rotational movement of driven gear 504 is transferred to impeller shaft 412 depends on the extent of the engagement of output portion 526 with input portion 524 (e.g., the extent of the engagement of the clutch assembly). Clutch assembly 462 is selectively engaged and disengaged (e.g., clutched or declutched, etc.) to transfer the desired amount of rotational movement from driven gear 504 to impeller shaft 412. According to one exemplary embodiment, clutch assembly 462 is an electric clutch. According to various alternative embodiments, clutch assembly 462 may be selected from any suitable clutch that is, or may become, commercially available, or the clutch may be specifically configured for use with the fire pump gear case, including but not limited to, a hydraulic or a pneumatic clutch.

Coupling clutch assembly 462 directly to impeller shaft 412, rather than between the drive source (e.g., rear engine power take-off device 314, etc.) and gear case 450, advantageously allows fire pump 410 to be selectively turned on and off without affecting the operation of gear case 450. Since gear case 450 may optionally be used to drive an auxiliary device (e.g., a standard transmission type PTO, etc.), allowing gear case 450 to operate independent of fire pump 410 enables an auxiliary device to operate when fire pump 410 is turned off. A further advantage of the disclosed clutch arrangement is that by coupling clutch assembly 462 directly to impeller shaft 412, impeller shaft 412 may be more convenient to service. To service, second cover 468 can be removed and the entire impeller shaft 412 can be pulled out through third opening 474. This can be readily done from above and/or below chassis 70 with cab 100 in the service position. Further, servicing of impeller shaft 412 (or other components of fire pump system 400) can be done without removing fire pump control panel 570.

Referring back to FIGS. 8 through 11, fluid routing system 530 constitutes a series of conduits (e.g., piping, plumbing, etc.) provided to direct the flow of fluid into and out of the fluid inlets and/or fluid outlets of fire pump 410. Fluid routing system 530 directs the flow of firefighting agent to and from various locations on vehicle 50. Fluid routing system 530 generally includes an input routing portion 532 and an output routing portion 534.

Input routing portion 532 comprises a substantially T-shaped fitting 536 having a first opening 538 configured to direct a fluid into fluid inlet 422 along a path generally parallel to axis A-A and second and third openings 540, 542 facing directions generally perpendicular to first opening 538. Second and third openings 540, 542 are each configured to receive a conduit 544, 546 respectively. Conduits 544, 546 extend outward in a direction that is substantially perpendicular to chassis 70 to provide fluid inlet port along each lateral side of vehicle 50. Fluid entering conduits 544, 546 is generally provided from a source external to vehicle 50 (e.g., a hydrant, etc.).

Referring to FIG. 11, conduits 544, 546 extend over chassis rails 78 and then extend downward to clear other portions of vehicle 50. Free ends of conduits 544, 546 are configured to support hose connectors 548, 550 respectively (shown in FIGS. 1 and 2) to which a fire hose can be selectively connected. Hose connectors 548, 550 are provided along chassis 70 forward of body 200 and fire pump control panel 570.

Input routing portion 532 is further shown as including a fourth opening 552 located on fitting 536. Fourth opening 552 is substantially perpendicular to second and third openings 540, 542 and faces in a rearward direction. Fluid entering fourth opening 552 is generally provided from a source within vehicle 50. For example, fourth opening 552 is configured to be in fluid communication with the water tank supported on chassis 70 between body sections 206, 208.

Output routing portion 534 generally comprises a first conduit 554 coupled to first fluid outlet of pump housing 414 and a second conduit 556 coupled to second fluid outlet of pump housing 414. Similar to conduits 544, 546, first and second conduits 554, 556 extend outward in a direction that is substantially perpendicular to chassis 70. Referring to FIG. 11, first and second conduits 554, 556 extend over chassis rails 78 and then extend downward to clear other portions of vehicle 50. Free ends of first and second conduits 554, 556 are configured to support one or more hose connectors 558, 560 respectively (shown in FIGS. 1 and 2) to which a fire hose can be selectively connected. Hose connectors 558, 560 are provided along chassis 70 under a rear portion of cab 100 to provide fluid discharge port along each lateral side of vehicle 50. According to one exemplary embodiment, hose connectors 558, 560 each include two fluid outlets stacked vertically as shown in FIG. 1. According to another exemplary embodiment, hose connectors 558, 560 include two fluid outlets stacked horizontally as shown in FIG. 11. According to various alternative embodiments, hose connectors 558, 560 may have any of a number of suitable configurations with any number of outlets.

Output routing portion 534 is further shown as including a third conduit 562 located at a rear portion of pump housing 414. Third conduit 562 extends rearward in a direction that is substantially perpendicular to first and second conduits 554, 556. Third conduit 562 is configured to be in fluid communication with a fire pump manifold 564. Fire pump manifold 564 is configured to receive a pressurized firefighting agent from fire pump 410 and selectively distribute the fluid to various systems on vehicle 50 (e.g., CAFS, turret, water tank, etc.) Fire pump manifold 564 is supported within body 200 and is controlled by fire pump control panel 570.

According to various alternative embodiments, input routing portion 532 and output routing portion 534 may be formed by any suitable assembly of components, or alternatively may each be provided as an integrally formed one-piece unitary body. According to further alternative embodiments, input routing portion 532 and output routing portion 534 may have any number of inlets and outlets, supported at various locations about vehicle 50, depending on various design criteria (e.g., the type of vehicle, intended application, etc.).

Figure 19:
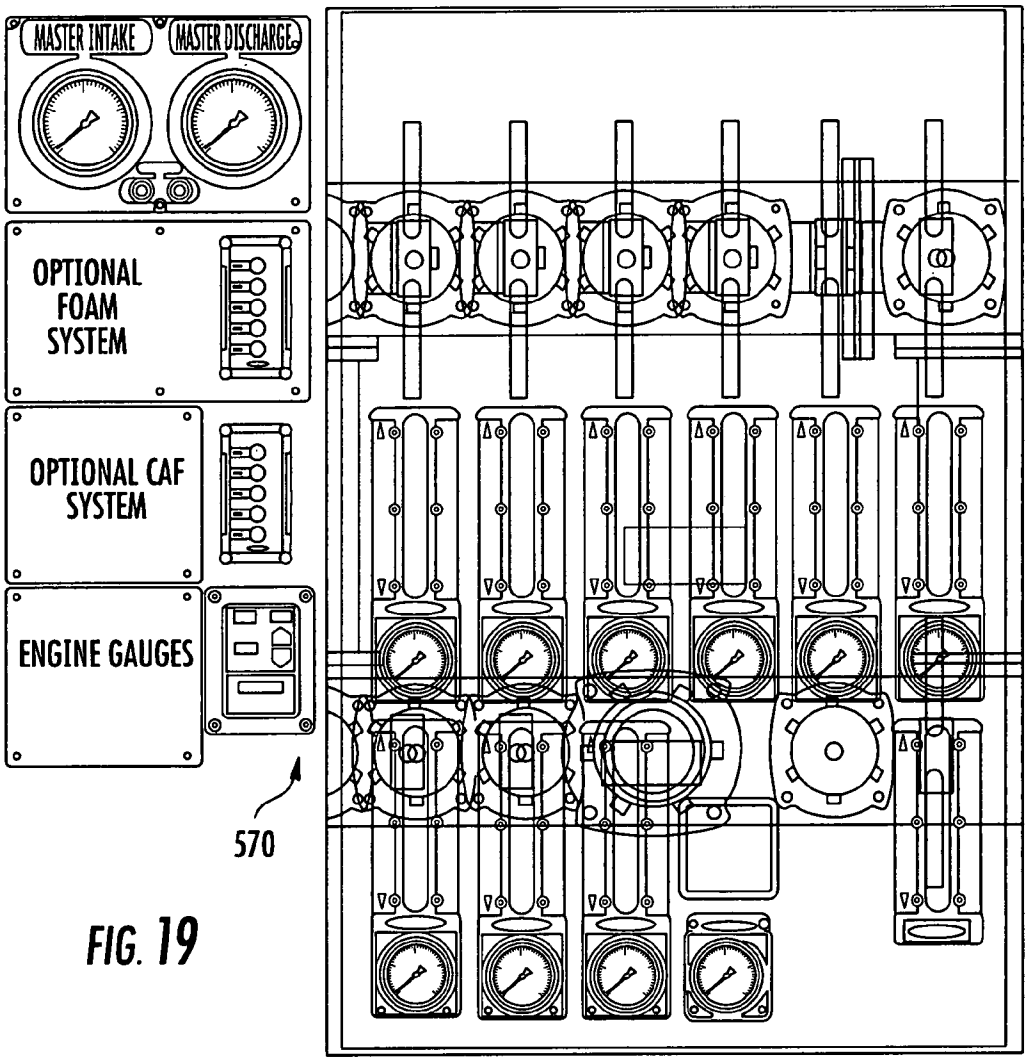
FIG. 19 is a front plan view of a fire pump control panel according to an exemplary embodiment.

Referring to FIG. 19, fire pump control panel 570 comprises an arrangement configured to enable control of fire pump 410, manifold 564, and any other system that may need to be controlled (e.g., CAFS, etc.). Fire pump control panel 570 includes one or more displays and gauges that communicate to an operator the status of fire pump 410 and the various other systems. Fire pump control panel 570 further includes one or more buttons, levers, switches or other control mechanisms configured to enable an operator to manually control and adjust the operation or the status and configuration of fire pump 410 and the valves of manifold 564. According to an exemplary embodiment, fire pump control panel 570 includes one or more mechanical linkages that extend from fire pump control panel 570 and that are connected to global actuation portions of fire pump 410 and the valves of manifold 564. Such linkages are pushed, pulled or rotated to adjust the operation of fire pump 410 and the valves of manifold 564. Use of such linkages enables reliable control of fire pump 410 and the valves of manifold 564 without requiring electrical power and additional wiring. According to various alternative embodiments, one or more of such linkages may alternatively be replaced with one or more electrical control mechanisms or any other suitable device.

As mentioned above, fire pump control panel 570 is located within body 200 and is rearward of inlet hose connectors 548, 550 and outlet hose connectors 558, 560. Existing pump system generally position at least one of an fluid inlet hose connector and a fluid outlet hose connector on a pump control panel. By removing inlet hose connectors 548, 550 and outlet hose connectors 558, 560 from fire pump control panel 570 and positioning them forward of fire pump control panel 570, a pump operator may be protected in the event that one or more hoses connected to the fluid inlets and/or fluid outlets inadvertently disconnects while under pressure.

Overall, vehicle 50 provides a firefighting vehicle that is simpler to construct and maintain, that is better for high-speed maneuvering and that has more space for storage as compared to conventional firefighting vehicles. Because vehicle 50 includes a fire pump system 400 that is at least partially supported under cab 100, rather than at a mid portion or rear of the vehicle, additional space along chassis 70 is available for storage. If the additional space available for storage is not needed, chassis 70 may be shortened thereby improving the maneuverability of vehicle 50. Because fire pump system 400 is supported at least partially below cab 100 and along a centerline of the vehicle, vehicle 50 has a lower and more evenly distributed center of gravity, improving the maneuverability of vehicle 50. Because fire pump system 400 incorporates a fire pump 410 with a pump housing 414 that includes two discharge outlets off of the same volute, a more compact pump configuration can be provided. Because fire pump system 400 is drive by rear engine power take-off device 314, remaining power take-off devices (e.g., those coupled to transmission 304) can be used for operating other systems. Because clutch assembly 462 is coupled directly to impeller shaft 412, fire pump system 400 can be turned off while other systems powered by the same drive remain running. Because clutch assembly 462 is coupled directly to impeller shaft 412, impeller shaft 412 may be easier to service and/or replace. Because ladder 248 is stowed along the same side of vehicle 50 that supports fire pump control panel 570, the opposite side will have an increased storage capacity. Because fluid inlets and outlets are moved out of fire pump control panel 570, a pump operator may be protected form an inadvertent disconnect of a pressurized fire hose. Although each of the aforementioned features and benefits have been described as being utilized in conjunction with one another as part of firefighting vehicle 50, such features may alternatively be used independent of one another and may be used on other vehicles including those used for firefighting or for other purposes.

It is also important to note that the construction and arrangement of the elements of vehicle 50 and/or fire pump system 400 as shown in the exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the firefighting vehicle may be constructed from any of a wide variety of materials that provide sufficient strength or durability, in any of a wide variety of colors, textures and combinations. Accordingly, all such modifications are intended to be included within the scope of the present inventions. Other substitutions, modifications, changes and omissions may be made in the design, operating conditions and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims.

What is claimed is:

1. A firefighting vehicle comprising:

a chassis;

an operator cab supported at a front portion of the chassis and movable relative to the chassis between a transit position and a service position;

a fire pump supported by the chassis at least partially under a rear portion of the operator cab, the fire pump comprising;

a shaft;

an impeller supported by the shaft, the impeller having a periphery; and a fire pump housing which encloses the impeller and supports the shaft for rotation about an axis, the housing including the fluid inlet configured to direct a fluid into the housing along a path generally parallel to the axis, and the housing including two fluid outlets configured to direct the fluid from the housing along two respective paths generally perpendicular to the axis, the direction of fluid flow from the fluid outlets being generally in opposite directions with a first outlet supported at a first lateral side of the vehicle and a second outlet supported at a second lateral side of the vehicle, wherein the shaft rotates the impeller in a pumping direction to move fluid from the fluid inlet to the fluid outlets;

a drive system supported by the chassis and comprising an engine and a transmission, at least the engine being positioned under the operator cab and forward of the fire pump;

a tank configured to store a firefighting agent, the tank being supported by the chassis rearward of the operator cab and in fluid communication with a fluid inlet of the fire pump;

fire hose connectors at the fluid flow outlet, the fire hose connectors being supported under the rear portion of the cab; and two fluid conduits in fluid communication with the fluid inlet, the conduits being configured to move fluid along a path generally perpendicular to the axis of the fluid inlet.

2. The firefighting vehicle of claim 1 further comprising a body supported by the chassis rearward of the operator cab, the body providing at least one storage compartment and at least partially surrounding the tank.

3. The firefighting vehicle of claim 2 a fire pump control panel supported at a front portion of the body.

4. The firefighting vehicle of claim 1 wherein the engine comprises a first output operatively coupled to the transmission and a second output operatively coupled to the fire pump.

5. The firefighting vehicle of claim 4 wherein the second output is a rear engine power take off device configured to rotate whenever the engine is operating.

6. The firefighting vehicle of claim 4 wherein a clutch is provided between the second output of the engine and the fire pump which allows the fire pump to be selectively disengaged from the second output to stop the fire pump from pumping.

7. The firefighting vehicle of claim 6 wherein the clutch is at least one of an electric clutch, a pneumatic clutch, and a hydraulic clutch.

8. The firefighting vehicle of claim 6 wherein a gearbox is provided between the second output and the fire pump to operatively couple the second output to the fire pump.

9. The firefighting vehicle of claim 8 wherein the clutch is operatively coupled between the gearbox and the fire pump.

10. The firefighting vehicle of claim 9 wherein the clutch is fixed to an impeller shaft of the fire pump.

11. The firefighting vehicle of claim 1 wherein each fluid outlet is at the periphery of the impeller.

12. The firefighting vehicle of claim 1 further comprising water supply hose connectors coupled to the two fluid conduits.

13. The firefighting vehicle of claim 12 wherein a first water supply hose connector is supported at the first lateral side of the vehicle and a second water supply hose connector is supported at the second lateral side of the vehicle.

14. The firefighting vehicle of claim 13 wherein the first and second water supply hose connectors are supported rearwardly adjacent the first and second fire hose connectors respectively.

15. The firefighting vehicle of claim 14 further comprising a body supported on the chassis rearward of the cab, the body providing at least one storage compartment.

16. The firefighting vehicle of claim 15 wherein the first and second water supply hose connectors are supported forward of the body.

17. The firefighting vehicle of claim 15 furthering comprising a fire pump control panel supported at a front portion of the body.

18. The firefighting vehicle of claim 17 wherein the fire pump control panel is supported at the front portion of the body along a driver's side of the vehicle.

19. The firefighting vehicle of claim 18 further comprising a storage compartment within the body along the driver's side of the vehicle for a ladder configured to be inserted into from the storage compartment from a rear end of the vehicle, a forward end of a stowed ladder is configured to be positioned behind the fire pump control panel.

20. The firefighting vehicle of claim 17 wherein the first and second water supply hose connectors are supported forward of the fire pump control panel.

21. The firefighting vehicle of claim 20 further comprising a panel moveable relative to the body and selectively positionable between at least one of the first and second water supply hose connectors and the fire pump control panel for shielding a pump operator from a possible inadvertent disconnect of a pressurized water supply hose.

22. The firefighting vehicle of claim 1 wherein the cab is a tilt cab rotatably coupled to the chassis at a front end and configured to be selectively tilted forward to achieve the service position, the tilt cab having raised floor at least in a rear portion of the tilt cab.

23. The firefighting vehicle of claim 22 wherein the fire pump is supported entirely under the raised floor of the tilt cab.

24. A firefighting vehicle comprising:

a chassis;

an operator cab supported at a front portion of the chassis and movable relative to the chassis between a transit position and a service position;

a fire pump supported by the chassis at least partially under a rear portion of the operator cab, the fire pump comprising an enclosure including a fluid inlet and two fluid outlets, a shaft supported by the enclosure and having an axis of rotation, and an impeller supported by shaft and having a periphery, the fluid inlet configured to direct a fluid into the enclosure along a path generally parallel to the axis, wherein the two fluid outlets are each defined by the enclosure at the periphery of the impeller and configured to direct the fluid from the enclosure along respective paths generally perpendicular to the axis;

a drive system supported by the chassis and comprising an engine and a transmission, at least the engine being positioned under the operator cab and forward of the fire pump;

a tank configured to store a firefighting agent, the tank being supported by the chassis rearward of the operator cab and in fluid communication with a fluid inlet of the fire pump;

fire hose connectors at the fluid flow outlets, the fire hose connectors being supported under the rear portion of the cab; and two fluid conduits in fluid communication with the fluid inlet, the conduits being configured to move fluid along a path generally perpendicular to the axis of the fluid inlet.

25. The firefighting vehicle of claim 24 wherein the engine comprises a first power output and a second power output, the first power output coupled to the transmission, the second power output coupled to the fire pump, and wherein the fire pump further comprises a clutch fixed to an end of the shaft opposite the impeller, wherein the clutch allows the shaft to be selectively disengaged from the second power output of the engine.

26. The firefighting vehicle of claim 25 wherein the clutch is at least one of an electric clutch, a pneumatic clutch, and a hydraulic clutch.

27. The firefighting vehicle of claim 25 further comprising a gear case operatively coupled between the second power output of the engine and the fire pump.

28. The firefighting vehicle of claim 27 wherein the clutch is operatively coupled between the gear case and the shaft.

29. The firefighting vehicle of claim 25 wherein the second power output of the engine is a rear engine power take off device which is power wherein the engine is operating.

30. The firefighting vehicle of claim 24 further comprising a body supported by the chassis rearward of the operator cab.

31. The firefighting vehicle of claim 30 further comprising a fire pump control panel supported at a front portion of the body.

32. The firefighting vehicle of claim 24 further comprising water supply hose connectors coupled to the two fluid conduits.

33. The firefighting vehicle of claim 32 wherein a first water supply hose connector is supported at a first lateral side of the vehicle and a second water supply hose connector is supported at a second lateral side of the vehicle.

34. The firefighting vehicle of claim 33 wherein the first and second water supply hose connectors are supported rearward of the first and second fire hose connectors respectively.

35. The firefighting vehicle of claim 34 further comprising a body supported on the chassis rearward of the cab, the body providing at least one storage compartment.

36. The firefighting vehicle of claim 35 wherein the first and second water supply hose connectors are supported forward of the body.

* * * * *